US007892052B2

(12) United States Patent
Suzuki et al.

(10) Patent No.: US 7,892,052 B2
(45) Date of Patent: Feb. 22, 2011

(54) BOAT PROPULSION SYSTEM, CONTROL DEVICE THEREOF, AND CONTROL METHOD

(75) Inventors: Takayoshi Suzuki, Shizuoka (JP); Hideaki Matsushita, Shizuoka (JP); Daisuke Nakamura, Shizuoka (JP); Tsugunori Konakawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 221 days.

(21) Appl. No.: 12/393,114

(22) Filed: Feb. 26, 2009

(65) Prior Publication Data

US 2009/0215331 A1 Aug. 27, 2009

(30) Foreign Application Priority Data

Feb. 27, 2008 (JP) ..... 2008-045602

(51) Int. Cl.
*B63H 21/21* (2006.01)

(52) U.S. Cl. ..... 440/1; 440/86

(58) Field of Classification Search ..... 440/1, 440/84, 85, 86; 74/491; 701/21
See application file for complete search history.

(56) References Cited

U.S. PATENT DOCUMENTS 5,711,742 A * 1/1998 Leinonen et al. ..... 440/75
7,553,206 B2 * 6/2009 Hasegawa et al. ..... 440/84
7,762,858 B2 * 7/2010 Suzuki et al. ..... 440/1
7,762,859 B2 * 7/2010 Suzuki et al. ..... 440/1
2003/0013354 A1 * 1/2003 Yanagihara ..... 440/1
2006/0213301 A1 9/2006 Mizuguchi et al.

FOREIGN PATENT DOCUMENTS

JP 2006-264361 A 10/2006

* cited by examiner

*Primary Examiner*—Lars A Olson
(74) *Attorney, Agent, or Firm*—Keating & Bennett, LLP

(57) ABSTRACT

A boat propulsion system includes a power source, a propulsion unit, a propeller rotational speed detection section, a shift mechanism, an actuator, a control lever, a shift position detection section, an accelerator opening detection section, and a control unit. When the control lever is operated such that a shift position is changed from a first shift position to a second shift position, while the absolute value of accelerator opening varying speed becomes equal to or larger than a predetermined value, the control unit enables the actuator to maintain the first shift position until the rotational speed of a propeller becomes equal to or lower than a predetermined rotational speed and then to change to the second shift position. This minimizes a load generated on the power source, the power transmission mechanism, and other components of the boat propulsion system.

9 Claims, 21 Drawing Sheets

| Part name (reference numeral) | ○ : Clutch engaged × : Clutch disengaged | | | | |
|---|---|---|---|---|---|
| Transmission gear ratio change hydraulic clutch (53) | × | ○ | × (○) | × | ○ |
| First shift change hydraulic clutch (61) | × | × | × | ○ | ○ |
| Second shift change hydraulic clutch (62) | ○ | ○ | × | × | × |
| One-way clutch (58) | Prevents reverse rotation | Allows forward rotation | Does not operate | Prevents reverse rotation | Allows forward rotation |
| Shift position | Low-speed forward | High-speed forward | Neutral | Low-speed reverse | High-speed reverse |

FIG. 6

BOAT PROPULSION SYSTEM, CONTROL DEVICE THEREOF, AND CONTROL METHOD

BACKGROUND OF THE INVENTION

1. Field of the Invention

The present invention relates to a boat propulsion system, a control device thereof, and a control method. Specifically, the present invention relates to a boat propulsion system provided with a shift mechanism of an electronic control type, a control device thereof, and a control method.

2. Description of the Related Art

A conventional device includes a shift mechanism of an outboard motor that is operated by an electric actuator to change a shift position, as described in JP-A-2006-264361, for example. An electric actuator connects or disconnects a dog clutch to perform a shift change among forward, reverse, and neutral in the shift mechanism, as described in JP-A-2006-264361.

A boat is accelerated, decelerated, or stopped only by a shift operation being performed in the boat. Specifically, when a boat is to be accelerated, decelerated, or stopped, a shift change is performed to a shift position on a side opposite to the present shift position to generate propulsive force in a direction opposite to a proceeding direction of the boat.

However, when a shift change is performed in a direction opposite to a proceeding direction, a rotational direction of a propeller shaft is reversed between before and after the shift change. Therefore, when a shift change is performed to a direction opposite to a proceeding direction, a load is generated on a power source, a power transmission mechanism, and so forth. In particular, if the rotational speed of the propeller is high when a clutch is reconnected, the load generated on the power source, the power transmission mechanism, and so forth becomes large when the shift change is performed in a direction opposite to a proceeding direction.

SUMMARY OF THE INVENTION

In order to overcome the problems described above, preferred embodiments of the present invention improve durability of a power source, a power transmission mechanism, and so forth in a boat propulsion system provided with a shift mechanism of an electronic control type by reducing load generated on the power source, the power transmission mechanism, and so forth when a shift change is performed in a direction opposite to a proceeding direction.

A boat propulsion system according to a preferred embodiment of the present invention includes a power source, a propulsion unit for a boat, a rotational speed detection section, a shift mechanism, an actuator, a control lever, a shift position detection section, an accelerator opening detection section, and a control unit. The power source generates a rotational force. The propulsion unit has a propeller operated by the rotational force of the power source. The propulsion unit generates a propulsive force. The rotational speed detection section detects a rotational speed of the propeller. The shift mechanism is disposed between the power source and the propulsion unit. The shift mechanism changes a first shift position, neutral, and a second shift position that transmits the rotational force of the power source to the propulsion unit as a rotational force in a rotational direction opposite to that of the first shift position. The actuator drives the shift mechanism. The accelerator opening and the shift position are input to the control lever by an operation of an operator. The shift position detection section detects the input shift position. The accelerator opening detection section detects the input accelerator opening. The control unit enables the actuator to select a shift position on the basis of the detected shift position and, at the same time, controls an output of the power source on the basis of the detected accelerator opening. When the control lever is operated such that the shift position detected by the shift position detection section is changed from the first shift position to the second shift position, and such that the absolute value of the accelerator opening varying speed obtained by differentiating the accelerator opening becomes equal to or larger than a predetermined value, the control unit enables the actuator to maintain the first shift position until the rotational speed of the propeller becomes equal to or lower than a predetermined rotational speed and then to change to the second shift position.

A control device of the boat propulsion system according to a preferred embodiment of the present invention relates to a control device of a boat propulsion system provided with a power source, a propulsion unit for a boat, a rotational speed detection section, a shift mechanism, an actuator, a control lever, a shift position detection section, and an accelerator opening detection section. The power source generates a rotational force. The propulsion unit has a propeller operated by the rotational force of the power source. The propulsion unit generates a propulsive force. The rotational speed detection section detects a rotational speed of the propeller. The shift mechanism is disposed between the power source and the propulsion unit. The shift mechanism changes a first shift position, neutral, and a second shift position that transmits a rotational force of the power source to the propulsion unit as rotational force in a rotational direction opposite to that of the first shift position. The actuator drives the shift mechanism. The accelerator opening and the shift position are input to the control lever by an operation of an operator. The shift position detection section detects the input shift position. The accelerator opening detection section detects the input accelerator opening.

The control device of the boat propulsion system according to a preferred embodiment of the present invention enables the actuator to select a shift position on the basis of the detected shift position and, at the same time, controls an output of the power source on the basis of the detected accelerator opening. When the control lever is operated such that the shift position detected by the shift position detection section is changed from the first shift position to the second shift position, and that the absolute value of the accelerator opening varying speed obtained by differentiating the accelerator opening becomes equal to or larger than a predetermined value, the control device of the boat propulsion system according to a preferred embodiment of the present invention enables the actuator to maintain the first shift position until the rotational speed of the propeller becomes equal to or lower than a predetermined rotational speed and then to change to the second shift position.

A control method of the boat propulsion system according to yet another preferred embodiment of the present invention relates to a control method of a boat propulsion system provided with a power source, a propulsion unit for a boat, a rotational speed detection section, a shift mechanism, an actuator, a control lever, a shift position detection section, and an accelerator opening detection section. The power source generates a rotational force. The propulsion unit has a propeller operated by the rotational force of the power source. The propulsion unit generates a propulsive force. The rotational speed detection section detects a rotational speed of the propeller. The shift mechanism is disposed between the power source and the propulsion unit. The shift mechanism changes a first shift position, neutral, and a second shift position that transmits the rotational force of the power source to the propulsion unit as a rotational force in a rotational direction opposite to that of the first shift position. The actuator drives the shift mechanism. The accelerator opening and the shift position are input to the control lever by an operation of the operator. The shift position detection section detects the input shift position. The accelerator opening detection section detects the input accelerator opening.

When the control lever is operated such that the shift position detected by the shift position detection section is changed from the first shift position to the second shift position, and such that the absolute value of the accelerator opening varying speed obtained by differentiating the accelerator opening becomes equal to or larger than a predetermined value, the control method of a boat propulsion system according to a preferred embodiment of the present invention enables the actuator to maintain the first shift position until the rotational speed of the propeller becomes equal to or lower than a predetermined rotational speed and then to change to the second shift position.

Various preferred embodiments of the present invention reduce a load generated on a power source, a power transmission mechanism, and so forth in a boat propulsion system provided with a shift mechanism of an electronic control type when a shift change is performed in a direction opposite to a proceeding direction. Accordingly, it is possible to improve durability of the power source, the power transmission mechanism, and so forth.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 6 is a table showing engaging states of a first to a third hydraulic clutches and shift positions of the shift mechanism.

DETAILED DESCRIPTION OF THE PREFERRED EMBODIMENTS

One example of a preferred embodiment of the present invention will be described hereinafter with reference to an example of an outboard motor 20 shown in FIG. 1. However, the preferred embodiment described below is only one example of various preferred embodiments of the present invention. The present invention is not limited to the preferred embodiments described below. The boat propulsion system according to the present invention may be, for example, a so-called inboard engine or a so-called stern drive. The stern drive is also referred to as an inboard-out drive engine. The "stern drive" refers to a boat propulsion system that has at least a power source mounted on a hull. The "stern drive" also includes a system that has components other than a propulsion unit mounted on a hull.

Figure 1:
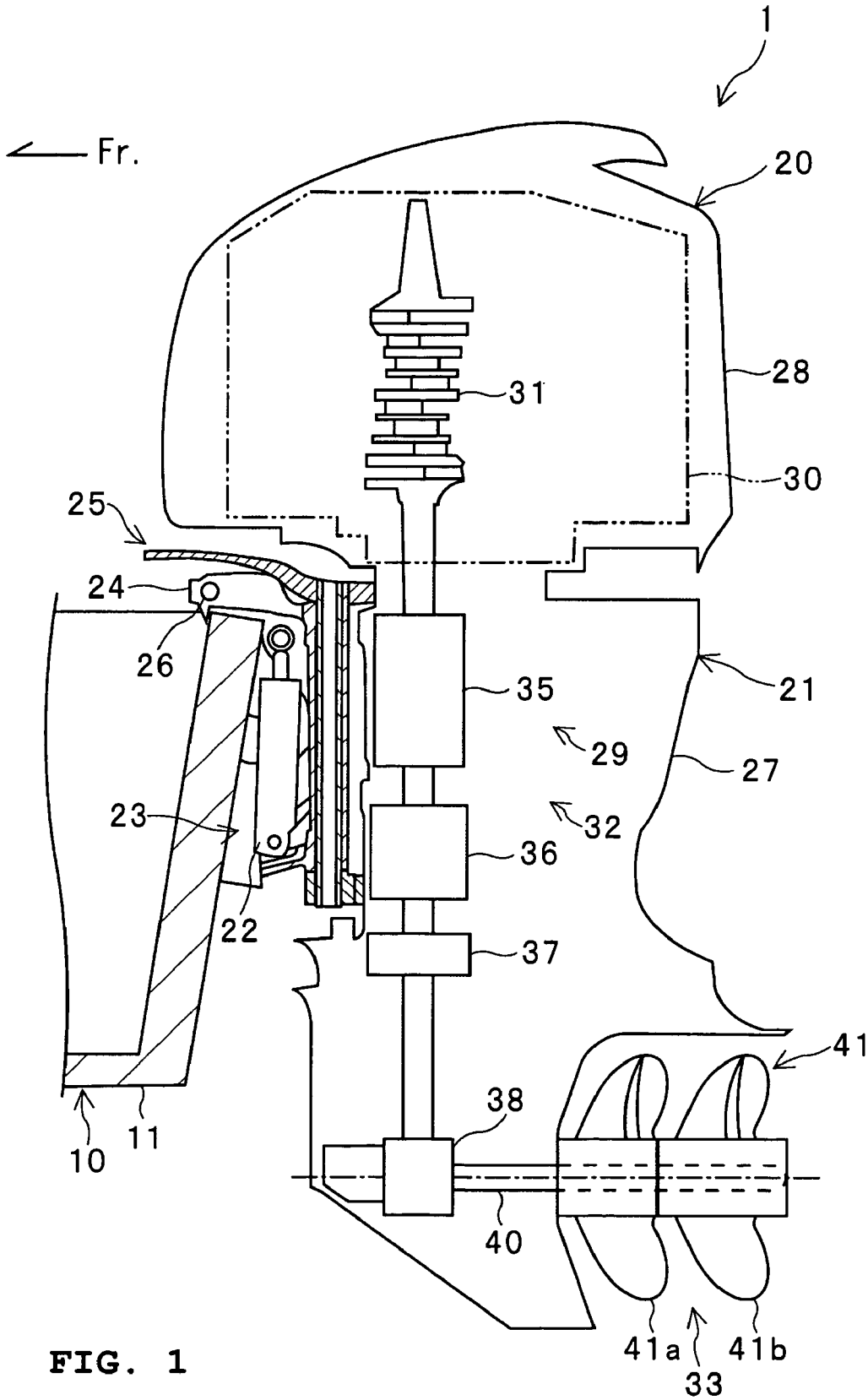
FIG. 1 is a partial cross-sectional view of a stern portion of a boat viewed from a side.

FIG. 1 is a partial cross-sectional view of a portion of a stern 11 of a boat 1 viewed from a side. As shown in FIG. 1, the boat 1 is provided with a hull 10 and the outboard motor 20 as a boat propulsion system. The outboard motor 20 is mounted on the stern 11 of the hull 10.

General Configuration of the Outboard Motor 20

The outboard motor 20 is provided with an outboard motor main body 21, a tilt/trim mechanism 22, and a bracket 23.

The bracket 23 is provided with a mount bracket 24 and a swivel bracket 25. The mount bracket 24 is fixed on the hull 10 by a screw or other connecting member, not shown.

The swivel bracket 25 is supported by the mount bracket 24 via a pivot 26. The swivel bracket 25 is vertically swingable around a central axis of the pivot 26. The outboard motor main body 21 is so-called rubber mounted on the swivel bracket 25.

The tilt/trim mechanism 22 performs a tilting operation and a trimming operation of the outboard motor main body 21.

The outboard motor main body 21 is provided with a casing 27, a cowling 28, and a propulsive force generation device 29. A large part of the propulsive force generation device 29 is disposed in the casing 27 and in the cowling 28.

Figure 2:
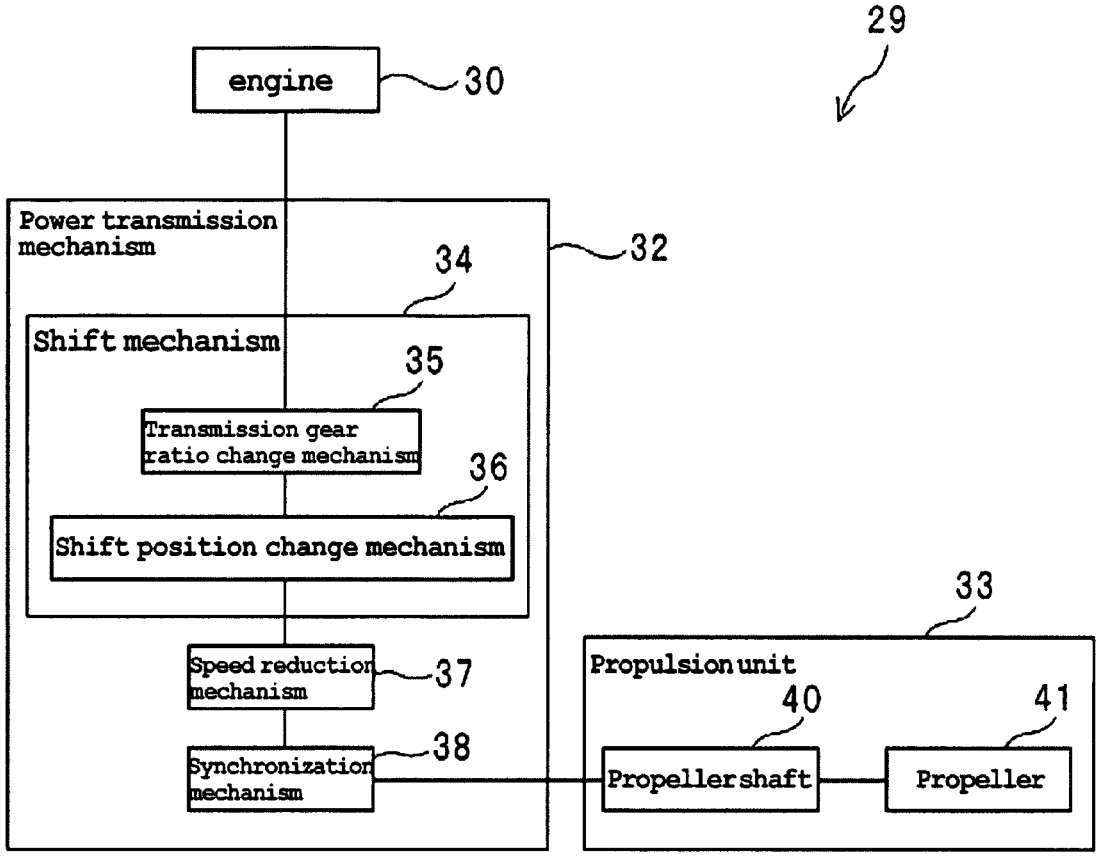
FIG. 2 is a schematic structure diagram showing a structure of a propulsive force generation device.

As shown in FIG. 1 and FIG. 2, the propulsive force generation device 29 is provided with an engine 30, a power transmission mechanism 32, and a propulsion unit 33.

In the present preferred embodiment, a description will be provided of an example in which the outboard motor 20 has the engine 30 as a power source. However, the power source is not particularly limited as long as the power source can generate a rotational force. For example, the power source may be an electric motor.

Figure 5:
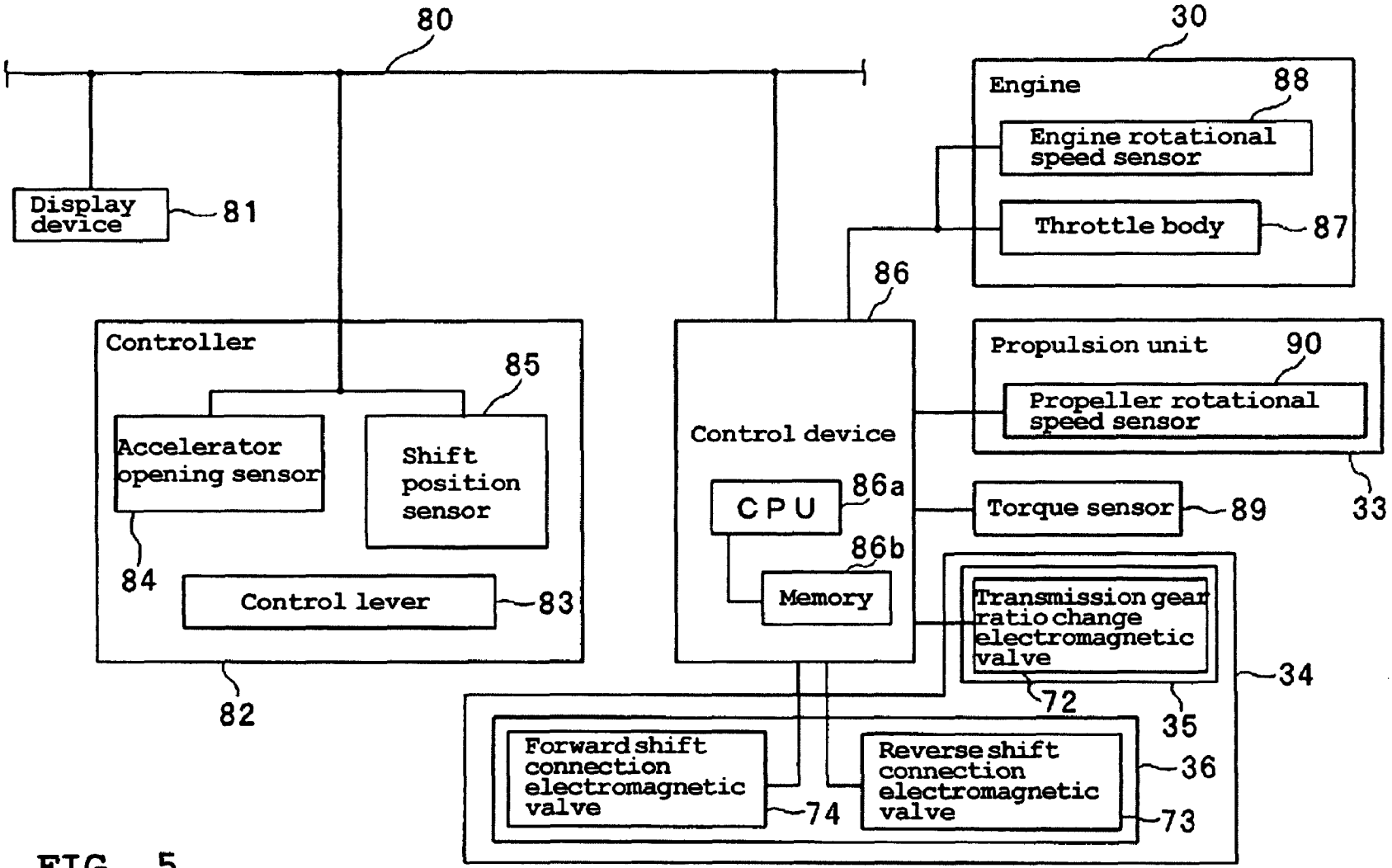
FIG. 5 is a control block diagram of the boat.

The engine 30 is preferably an engine of a fuel injection type that has a throttle body 87 shown in FIG. 5. The engine 30 generates a rotational force. As shown in FIG. 1, the engine 30 is provided with a crankshaft 31. The engine 30 outputs the generated rotational force via the crankshaft 31.

The power transmission mechanism 32 is disposed between the engine 30 and the propulsion unit 33. The power transmission mechanism 32 transmits the rotational force generated by the engine 30 to the propulsion unit 33. The power transmission mechanism 32 is provided with a shift mechanism 34, a speed reduction mechanism 37, and a synchronization mechanism 38.

The shift mechanism 34 is connected to the crankshaft 31 of the engine 30. As shown in FIG. 2, the shift mechanism 34 is provided with a transmission gear ratio change mechanism 35 and a shift position change mechanism 36.

The transmission gear ratio change mechanism 35 changes a transmission gear ratio between the engine 30 and the propulsion unit 33 between a high-speed transmission gear ratio (HIGH) and a low-speed transmission gear ratio (LOW). Here, the "high-speed transmission gear ratio" refers to a transmission gear ratio in which the ratio of the output side rotational speed to the input side rotational speed is relatively high. On the other hand, the "low-speed transmission gear ratio" refers to a transmission gear ratio in which the ratio of the output side rotational speed to the input side rotational speed is relatively low.

The shift position change mechanism 36 changes a shift position among forward, reverse, and neutral.

The speed reduction mechanism 37 is connected to the shift mechanism 34. The speed reduction mechanism 37 reduces the rotational force from the shift mechanism 34 to transmit the rotational fore to a side of the propulsion unit 33. A structure of the speed reduction mechanism 37 is not particularly limited. For example, the speed reduction mechanism 37 may have a planetary gear mechanism. Further, the speed reduction mechanism 37 may have a speed reduction gear-set.

The synchronization mechanism 38 is disposed between the speed reduction mechanism 37 and the propulsion unit 33. The synchronization mechanism 38 is provided with a bevel gear-set assembly not shown in the drawing. The synchronization mechanism 38 transmits the rotational force from the speed reduction mechanism 37 to the propulsion unit 33 by changing a direction thereof.

The propulsion unit 33 is provided with a propeller shaft 40 and a propeller 41. The propeller shaft 40 transmits the rotational force from the synchronization mechanism 38 to the propeller 41. The propulsion unit 33 converts the rotational force generated in the engine 30 into a propulsive force.

As shown in FIG. 1, the propeller 41 preferably includes two propellers; that is, a first propeller 41*a* and a second propeller 1*b*. A spiraling direction of the first propeller 41*a* and a spiraling direction of the second propeller 41*b* are preferably opposite directions to each other. When the rotational force output from the power transmission mechanism 32 is in a forward rotation direction, the first propeller 41*a* and the second propeller 41*b* rotate in opposite directions to each other, generating a propulsive force in the forward direction. Therefore, the shift position becomes forward. On the other hand, when the rotational force output from the power transmission mechanism 32 is in a reverse rotation direction, each of the first propeller 41*a* and the second propeller 41*b* rotates in a direction opposite to the direction at the time of advancing. This generates a propulsive force in the reverse direction. Therefore, the shift position becomes reverse.

Detailed Structure of the Shift Mechanism 34

Figure 3:
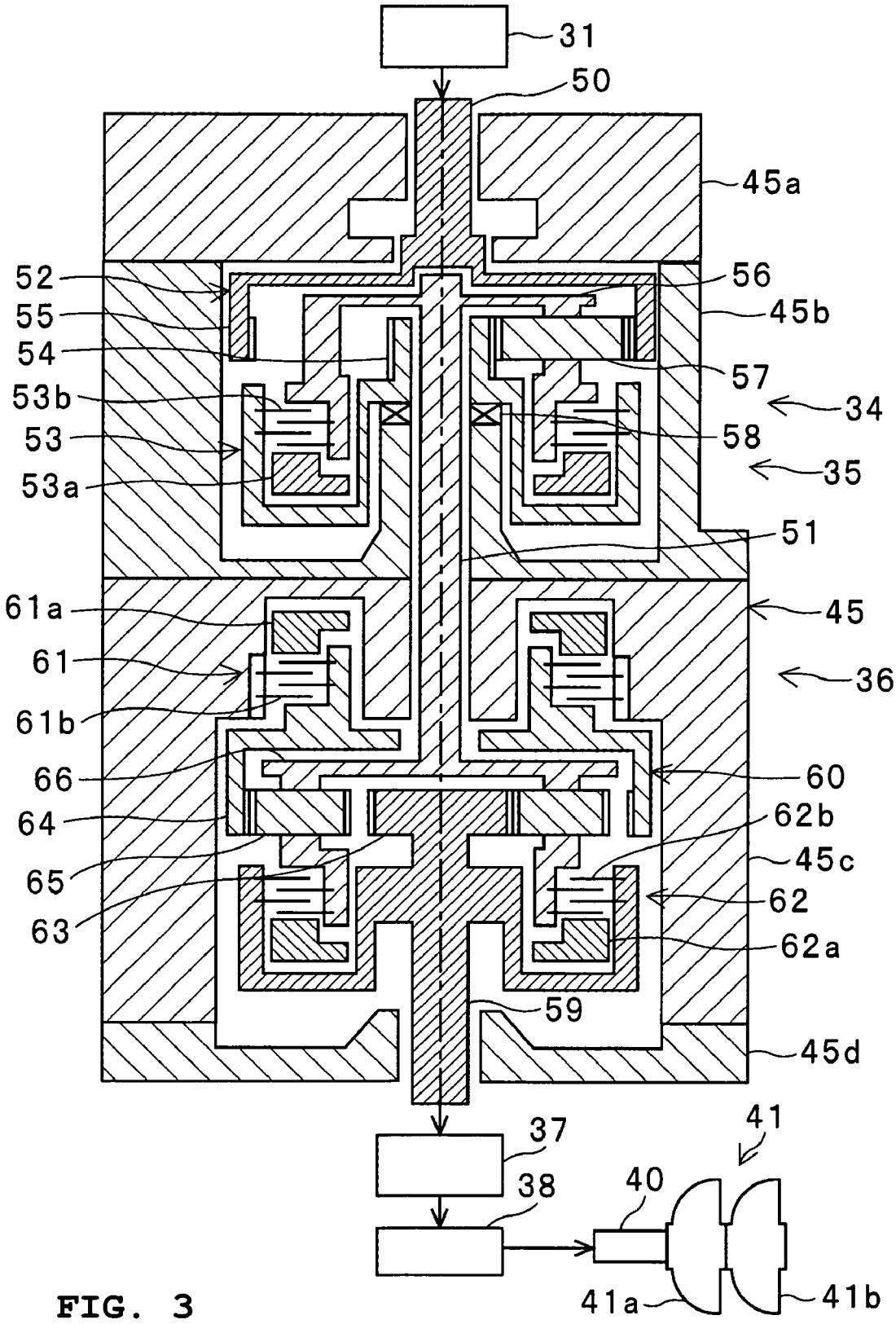
FIG. 3 is a schematic cross-sectional view of a shift mechanism.

A structure of the shift mechanism 34 in the present preferred embodiment will be described in detail mainly with reference to FIG. 3. However, the shift mechanism 34 shown in FIG. 3 is merely an example of a structure of the shift mechanism 34. In the present invention, the shift mechanism is not limited to the shift mechanism 34 shown in FIG. 3. FIG. 3 schematically shows the shift mechanism 34. Therefore, the structure of the shift mechanism 34 shown in FIG. 3 does not strictly agree with the structure of the actual shift mechanism 34.

The shift mechanism 34 is provided with a shift case 45. The shift case 45 is generally in a cylindrical shape in appearance. The shift case 45 is provided with a first case 45*a*, a second case 45*b*, a third case 45*c*, and a fourth case 45*d*. The first case 45*a*, the second case 45*b*, the third case 45*c*, and the fourth case 45*d* are mutually fixed by a bolt or other fastening or connecting member.

Transmission Gear Ratio Change Mechanism 35

The transmission gear ratio change mechanism 35 is provided with a first power transmission shaft 50 as an input shaft, a second power transmission shaft 51 as an output shaft, a planetary gear mechanism 52, and a transmission gear ratio change hydraulic clutch 53. The first power transmission shaft 50 and the second power transmission shaft 51 are coaxially disposed. The first power transmission shaft 50 is rotatably supported by the first case 45*a*. The second power transmission shaft 51 is rotatably supported by the second case 45*b* and the third case 45*c*. The first power transmission shaft 50 is connected to the crankshaft 31. Further, the first power transmission shaft 50 is connected to the planetary gear mechanism 52.

The planetary gear mechanism 52 is provided with a sun gear 54, a ring gear 55, and a carrier 56, and a plurality of planetary gears 57. The ring gear 55 is formed generally in a cylindrical shape. The ring gear 55 has gear teeth formed on an inner circumference thereof that mesh with the planetary gears 57. The ring gear 55 is connected to the first power transmission shaft 50. The ring gear 55 rotates together with the first power transmission shaft 50.

The sun gear 54 is disposed in the ring gear 55. The sun gear 54 and the ring gear 55 coaxially rotate. The sun gear 54 is attached to the second case 45*b* via a one-way clutch 58. While the one-way clutch 58 allows rotation in the forward direction, the one-way clutch 58 restricts rotation in the reverse direction. Therefore, while the sun gear 54 can rotate in the forward direction, the sun gear 54 cannot rotate in the reverse direction.

A plurality of the planetary gears 57 are disposed between the sun gear 54 and the ring gear 55. Each of the planetary gears 57 meshes with both the sun gear 54 and the ring gear 55. Each of the planetary gears 57 is rotatably supported by the carrier 56. Therefore, a plurality of the planetary gears 57 rotate respectively, revolving about an axial center of the first power transmission shaft 50 at the same speed.

In this specification, "rotation" means that a member turns around an axis located within the member. On the other hand, "revolution" means that a member turns around an axis located outside the member.

The carrier 56 is connected to the second power transmission shaft 51. The carrier 56 rotates together with the second power transmission shaft 51.

The transmission gear ratio change hydraulic clutch 53 is disposed between the carrier 56 and the sun gear 54. In the present preferred embodiment, the transmission gear ratio change hydraulic clutch 53 preferably is a wet-type multiple disc clutch. However, in the present invention, the transmission gear ratio change hydraulic clutch 53 is not limited to a wet-type multiple disc clutch. The transmission gear ratio change hydraulic clutch 53 may be a dry type multi-plate clutch or may be a so-called dog clutch, for example.

In this specification the "multiple disc clutch" refers to a clutch provided with a first member and a second member that are mutually rotatable, one or a plurality of first plates that rotate with the first member, and one or a plurality of second plates that rotate with the second member, in which rotation of the first member and the second member is restricted by pressing the first member and the second member into contact. In this specification, the "clutch" is not limited to a clutch disposed between an input shaft to which a rotational force is input and an output shaft from which the rotational force is output to connect or disconnect the input shaft and the output shaft.

The transmission gear ratio change hydraulic clutch 53 is provided with a hydraulic piston 53*a* and a plate group 53*b* including a clutch plate and a friction plate. As the hydraulic piston 53*a* is operated, the plate group 53*b* comes into pressurized contact. Accordingly, the transmission gear ratio change hydraulic clutch 53 is engaged. On the other hand, when the hydraulic piston 53*a* is in the non-operated state, the plate group 53*b* comes into non-pressurized contact. Accordingly, the transmission gear ratio change hydraulic clutch 53 is disengaged.

When the transmission gear ratio change hydraulic clutch 53 is engaged, the sun gear 54 and the carrier 56 are mutually fixed. Therefore, as the planetary gears 57 revolve, the sun gear 54 and the carrier 56 integrally rotate.

Shift Position Change Mechanism 36

The shift position change mechanism 36 is provided with the second power transmission shaft 51 as an input shaft, a third power transmission shaft 59 as an output shaft, a planetary gear mechanism 60, a first shift change hydraulic clutch 61, and a second shift change hydraulic clutch 62. The third power transmission shaft 59 is rotatably supported by the third case 45*c* and the fourth case 45*d*. The second power transmission shaft 51 and the third power transmission shaft 59 are coaxially disposed. In the present preferred embodiment, the hydraulic clutches 61, 62 are preferably wet-type multiple disc clutches. The second power transmission shaft 51 is a common member to the transmission gear ratio change mechanism 35 and the shift position change mechanism 36.

The shift position change mechanism 36 changes between forward as a second shift position, reverse as a first shift position, and neutral as described later in detail. In forward, the first shift change hydraulic clutch 61 is disengaged, while the second shift change hydraulic clutch 62 is engaged. In forward, the rotational force generated by the engine 30 is output from the shift position change mechanism 36 as a rotational force in the forward direction. In reverse, the first shift change hydraulic clutch 61 is engaged, while the second shift change hydraulic clutch 62 is disengaged. In reverse, the rotational force generated by the engine 30 is output from the shift position change mechanism 36 as a rotational force in the reverse direction. In neutral, both the second and the third hydraulic clutches 61, 62*a* are disengaged. In neutral, the rotational force generated by the engine 30 is not output from the shift position change mechanism 36. In other words, the rotational force generated by the engine 30 is not transmitted to the propulsion unit 33.

The planetary gear mechanism 60 is provided with a sun gear 63, a ring gear 64, a plurality of planetary gears 65, and a carrier 66.

The carrier 66 is connected to the second power transmission shaft 51. The carrier 66 rotates with the second power transmission shaft 51. Therefore, as the second power transmission shaft 51 rotates, the carrier 66 rotates, and, at the same time, a plurality of the planetary gears 65 revolve at the same speed.

A plurality of the planetary gears 65 mesh with the ring gear 64 and the sun gear 63. The first shift change hydraulic clutch 61 is disposed between the ring gear 64 and the third case 45*c*. The first shift change hydraulic clutch 61 is provided with a hydraulic piston 61*a* and a plate group 61*b* that includes a clutch plate and a friction plate. As the hydraulic piston 61*a* is operated, the plate group 61*b* comes into pressurized contact. Therefore, the first shift change hydraulic clutch 61 is engaged. As a result, the ring gear 64 is fixed to the third case 45*c* and becomes unrotatable. On the other hand, when the hydraulic piston 61*a* is in a non-operated state, the plate group 61*b* comes into non-pressurized contact. Therefore, the first shift change hydraulic clutch 61 is disengaged. As a result, the ring gear 64 becomes unfixed from the third case 45*c* and becomes rotatable.

The second shift change hydraulic clutch 62 is disposed between the carrier 66 and the sun gear 63. The second shift change hydraulic clutch 62 is provided with a hydraulic piston 62*a* and a plate group 62*b* that includes a clutch plate and a friction plate. As the hydraulic piston 62*a* is operated, the plate group 62*b* comes into pressurized contact. Therefore, the second shift change hydraulic clutch 62 is engaged. As a result, the carrier 66 and the sun gear 63 integrally rotate. On the other hand, when the hydraulic piston 62*a* is in a non-operated state, the plate group 62*b* comes into non-pressurized contact. Therefore, the second shift change hydraulic clutch 62 is disengaged. As a result, the ring gear 64 and the sun gear 63 become mutually rotatable.

Figure 4:
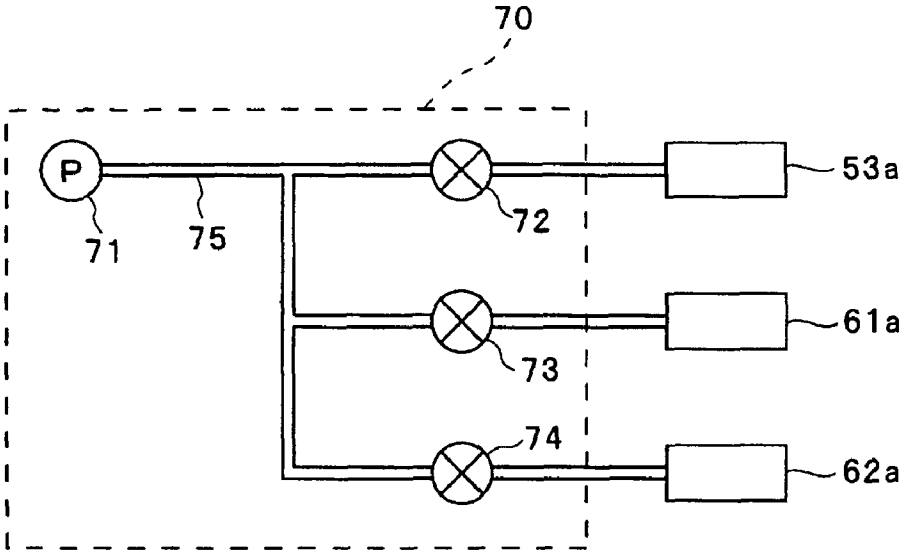
FIG. 4 is an oil circuit diagram.

As shown in FIG. 4, the hydraulic pistons 53*a*, 61*a*, and 62*a* are operated by an actuator 70. The actuator 70 is provided with an oil pump 71, a transmission gear ratio change electromagnetic valve 72, a reverse shift connection electromagnetic valve 73, and a forward shift connection electromagnetic valve 74. The oil pump 71 is connected to the hydraulic pistons 53*a*, 61*a*, and 62*a* by an oil path 75. The transmission gear ratio change electromagnetic valve 72 is disposed between the oil pump 71 and the hydraulic piston 53*a*. Hydraulic pressure of the hydraulic piston 53*a* is adjusted by the transmission gear ratio change electromagnetic valve 72. The reverse shift connection electromagnetic valve 73 is disposed between the oil pump 71 and the hydraulic piston 61*a*. Hydraulic pressure of the hydraulic piston 61*a* is adjusted by the reverse shift connection electromagnetic valve 73. The forward shift connection electromagnetic valve 74 is disposed between the oil pump 71 and the hydraulic piston 62*a*. Hydraulic pressure of the hydraulic piston 62*a* is adjusted by the forward shift connection electromagnetic valve 74.

Each of the transmission gear ratio change electromagnetic valve 72, the reverse shift connection electromagnetic valve 73, and the forward shift connection electromagnetic valve 74 can gradually change a path area of the oil path 75. Therefore, the transmission gear ratio change electromagnetic valve 72, the reverse shift connection electromagnetic valve 73, and the forward shift connection electromagnetic valve 74 can be used to gradually change a pressing force of the hydraulic pistons 53*a*, 61*a*, and 62*a*. Therefore, it is possible to gradually change a connection force of the hydraulic clutches 53, 61, and 62.

Specifically, in the present preferred embodiment, each of the transmission gear ratio change electromagnetic valve 72, the reverse shift connection electromagnetic valve 73, and the forward shift connection electromagnetic valve 74 is preferably constituted by a solenoid valve that is controlled by PWM (Pulse Width Modulation), for example. However, each of the transmission gear ratio change electromagnetic valve 72, the reverse shift connection electromagnetic valve 73, and the forward shift connection electromagnetic valve 74 may be constituted by a valve other than the solenoid valve that is controlled by PWM. For example, each of the transmission gear ratio change electromagnetic valve 72, the reverse shift connection electromagnetic valve 73, and the forward shift connection electromagnetic valve 74 may be constituted by a solenoid valve that is on-off controlled.

Shift Change Operation of the Shift Mechanism 34

A shift change operation of the shift mechanism 34 will be described hereinafter in detail mainly with reference to FIG. 3 and FIG. 6. FIG. 6 shows a table showing engaging states of the hydraulic clutches 53, 61, and 62 and shift positions of the shift mechanism 34. The shift positions are changed by engaging or disengaging of the first to the third hydraulic clutches 53, 61, and 62 in the shift mechanism 34.

Shifting Between the Low-Speed Transmission Gear Ratio and the High-Speed Transmission Gear Ratio Shifting between the low-speed transmission gear ratio and the high-speed transmission gear ratio is performed by the transmission gear ratio change mechanism 35. Specifically, the low-speed transmission gear ratio and the high-speed transmission gear ratio are changed by an operation of the transmission gear ratio change hydraulic clutch 53. Specifically, when the transmission gear ratio change hydraulic clutch 53 is disengaged, the "low-speed transmission gear ratio" is set. On the other hand, when the transmission gear ratio change hydraulic clutch 53 is engaged, the "high-speed transmission gear ratio" is set.

As shown in FIG. 3, the ring gear 55 is connected to the first power transmission shaft 50. Therefore, as the first power transmission shaft 50 rotates, the ring gear 55 rotates in the forward rotation direction. Here, when the transmission gear ratio change hydraulic clutch 53 is disengaged, the carrier 56 and the sun gear 54 are mutually rotatable. Therefore, the planetary gears 57 rotate and revolve at the same time. As a result, the sun gear 54 attempts to rotate in the reverse direction.

However, as shown in FIG. 6, the one-way clutch 58 interrupts rotation of the sun gear 54 in the reverse rotation direction. Therefore, sun gear 54 is fixed by the one-way clutch 58. As a result, as the ring gear 55 rotates, the planetary gears 57 revolve between the sun gear 54 and the ring gear 55. Consequently, the second power transmission shaft 51 rotates together with the carrier 56. In this case, as the planetary gears 57 rotate and revolve at the same time, rotation of the first power transmission shaft 50 is decelerated and transmitted to the second power transmission shaft 51. Therefore, the transmission gear ratio is set to the "low-speed transmission gear ratio."

On the other hand, when the transmission gear ratio change hydraulic clutch 53 is engaged, the planetary gears 57 and the sun gear 54 integrally rotate. Therefore, the rotation of the planetary gears 57 is prohibited. Therefore, as the ring gear 55 rotates, the planetary gears 57, the carrier 56, and the sun gear 54 rotate at the same rotational speed with the ring gear 55 in the forward rotation direction. Here, as shown in FIG. 6, the one-way clutch 58 allows the sun gear 54 to rotate in the forward rotation direction. As a result, the first power transmission shaft 50 and the second power transmission shaft 51 rotate at the same rotational speed in the forward rotation direction. In other words, the rotational force of the first power transmission shaft 50 is transmitted to the second power transmission shaft 51 at the same rotational speed and in the same rotation direction. Therefore, the gear ratio is set to the "high-speed transmission gear ratio."

Shifting Among Forward, Reverse, and Neutral

Shifting among forward, reverse, and neutral is performed by the shift position change mechanism 36. Specifically, forward, reverse, and neutral are changed by an operation of the first shift change hydraulic clutch 61 and the second shift change hydraulic clutch 62.

While the first shift change hydraulic clutch 61 is disengaged, when the second shift change hydraulic clutch 62 is engaged, "forward" is set. When the first shift change hydraulic clutch 61 is disengaged, the ring gear 64 is rotatable relative to the shift case 45. When the second shift change hydraulic clutch 62 is engaged, the carrier 66, the sun gear 63, and the third power transmission shaft 59 integrally rotate. Therefore, while the first shift change hydraulic clutch 61 is engaged, when the second shift change hydraulic clutch 62 is engaged, the second power transmission shaft 51, the carrier 66, the sun gear 63, and the third power transmission shaft 59 integrally rotate in the forward rotation direction. Therefore, the shift position becomes "forward."

While the first shift change hydraulic clutch 61 is engaged, when the second shift change hydraulic clutch 62 is disengaged, "reverse" is set. While the first shift change hydraulic clutch 61 is engaged, when the second shift change hydraulic clutch 62 is disengaged, rotation of the ring gear 64 is restricted by the shift case 45. On the other hand, the sun gear 63 becomes rotatable relative to the carrier 66. Accordingly, as the second power transmission shaft 51 rotates in the forward rotation direction, the planetary gears 65 rotate and revolve at the same time. As a result, the sun gear 63 and the third power transmission shaft 59 rotate in the reverse rotation direction. Therefore, the shift position becomes "reverse."

Further, when both the first shift change hydraulic clutch 61 and the second shift change hydraulic clutch 62 are disengaged, "neutral" is set. When both of the first shift change hydraulic clutch 61 and the second shift change hydraulic clutch 62 are disengaged, the planetary gear mechanism 60 is in an idling state. Therefore, rotation of the second power transmission shaft 51 is not transmitted to the third power transmission shaft 59. Accordingly, the shift position becomes "neutral."

As described above, the low-speed transmission gear ratio and the high-speed transmission gear ratio are changed, and the shift position is changed. Therefore, as shown in FIG. 6, while the transmission gear ratio change hydraulic clutch 53 and the first shift change hydraulic clutch 61 are disengaged, when the second shift change hydraulic clutch 62 is engaged, the shift position becomes "low-speed forward." While the transmission gear ratio change hydraulic clutch 53 and the second shift change hydraulic clutch 62 are engaged, when the first shift change hydraulic clutch 61 is disengaged, the shift position becomes "high-speed forward." When both of the first shift change hydraulic clutch 61 and the second shift change hydraulic clutch 62 are disengaged, the shift position becomes "neutral" regardless of the engaging state of the transmission gear ratio change hydraulic clutch 53. While the transmission gear ratio change hydraulic clutch 53 and the second shift change hydraulic clutch 62 are disengaged, when the first shift change hydraulic clutch 61 is engaged, the shift position becomes "low-speed reverse." Further, while the transmission gear ratio change hydraulic clutch 53 and the first shift change hydraulic clutch 61 are engaged, when the second shift change hydraulic clutch 62 is disengaged, the shift position becomes "high-speed reverse."

Control Block of the Boat 1

A control block of the boat 1 will be described hereinafter mainly with reference to FIG. 5.

A control block of the outboard motor 20 will be described first with reference to FIG. 5. A control device 86 is disposed in the outboard motor 20. The control device 86 controls each mechanism of the outboard motor 20. The control device 86 is provided with a CPU (central processing unit) 86*a* as an operation unit and a memory 86*b*. Various settings such as a map described later are stored in the memory 86*b*. The memory 86*b* is connected to the CPU 86*a*. When the CPU 86*a* performs various calculations, the CPU 86*a* reads out necessary information stored in the memory 86*b*. Further, the CPU 86*a* outputs calculation results to the memory 86*b* as necessary to make the memory 86*b* store the calculation results.

The throttle body 87 of the engine 30 is connected to the control device 86. The throttle body 87 is controlled by the control device 86. Rotational speed of the engine 30 is thereby controlled. As a result, the output of the engine 30 is controlled.

Further, an engine rotational speed sensor 88 is connected to the control device 86. The engine rotational speed sensor 88 detects the rotational speed of the crankshaft 31 of the engine 30 shown in FIG. 1. The engine rotational speed sensor 88 outputs the detected engine rotational speed to the control device 86.

A torque sensor 89 is provided between the engine 30 and the propeller 41. The torque sensor 89 detects torque generated between the engine 30 and the propeller 41. The torque sensor 89 outputs the detected torque to the control device 86.

An arrangement position of the torque sensor 89 is not particularly limited as long as the arrangement position is between the engine 30 and the propeller 41. The torque sensor 89 may be, for example, disposed on the crankshaft 31, the first to the third power transmission shafts 50, 51, 59, the propeller shaft 40, or the like. The torque sensor 89 can be constituted, for example, by a magnetostrictive sensor and so forth.

A propeller rotational speed sensor 90 is provided in the propulsion unit 33. The propeller rotational speed sensor 90 detects rotational speed of the propeller 41. The propeller rotational speed sensor 90 outputs the detected rotational speed to the control device 86. The rotational speed of the propeller 41 and the rotational speed of the propeller shaft 40 are substantially the same as each other. Therefore, the propeller rotational speed sensor 90 may detect the rotational speed of the propeller shaft 40.

The propeller rotational speed sensor 90 may directly detect rotational speed of the propeller 41 or of the propeller shaft 40. Further, the propeller rotational speed sensor 90 may detect rotational speed of the third power transmission shaft 59. Moreover, the propeller rotational speed sensor 90 may calculate the propeller rotational speed from rotational speed of the engine 30, a transmission gear ratio, and so forth.

Further, the transmission gear ratio change electromagnetic valve 72, the forward shift connection electromagnetic valve 74, and the reverse shift connection electromagnetic valve 73 are connected to the control device 86. Opening/closing and opening angle adjustment of the transmission gear ratio change electromagnetic valve 72, the forward shift connection electromagnetic valve 74, and the reverse shift connection electromagnetic valve 73 are controlled by the control device 86.

As shown in FIG. 5, the boat 1 is provided with a LAN (local area network) 80 extended over the hull 10. Signals are sent and received via the LAN 80 between devices in the boat 1.

The control device 86, a controller 82, and a display device 81 of the outboard motor 20 are connected to the LAN 80. The control device 86 outputs the detected engine rotational speed, the propeller rotational speed, and so forth. The display device 81 displays information output from the control device 86 and information output from the controller 82 described later. Specifically, the display device 81 displays a present speed, shift position, and so forth of the boat 1.

The controller 82 is provided with a control lever 83, an accelerator opening sensor 84, and a shift position sensor 85 as a shift position detection section. A shift position and an accelerator opening are input to the control lever 83 as a result of an operation by the operator of the boat 1. Specifically, as the operator operates the control lever 83, an accelerator opening and a shift position corresponding to a state of the control lever 83 are detected by the accelerator opening sensor 84 and the shift position sensor 85 respectively. Each of the accelerator opening sensor 84 and the shift position sensor 85 is connected to the LAN 80. The accelerator opening sensor 84 and shift position sensor 85 send the accelerator opening and the shift position to the LAN 80, respectively.

The control device 86 receives an accelerator opening signal and a shift position signal output from the accelerator opening sensor 84 and the shift position sensor 85 via the LAN 80.

Control of the Boat 1

Control of the boat 1 will be described hereinafter.

Basic Control of the Boat 1

When the control lever 83 is operated by the operator of the boat 1, the accelerator opening and the shift position corresponding to a situation of the control lever 83 are detected by the accelerator opening sensor 84 and the shift position sensor 85. The detected accelerator opening and the detected shift position are sent to the LAN 80. The control device 86 receives the accelerator opening signal and the shift position signal output via the LAN 80. The control device 86 controls the throttle body 87 in response to the accelerator opening signal. As a result, the control device 86 performs output control of the engine 30.

Further, the control device 86 controls the shift mechanism 34 in response to the shift position signal. Specifically, when the shift position signal of "low-speed forward" is received, the transmission gear ratio change electromagnetic valve 72 is operated, and the transmission gear ratio change hydraulic clutch 53 is disengaged. At the same time, while the shift connection electromagnetic valves 73, 74 are operated to disengage the first shift change hydraulic clutch 61, the second shift change hydraulic clutch 62 is engaged. As a result, the shift position is changed to "low-speed forward."

Specific Control of the Boat 1

Figure 7:
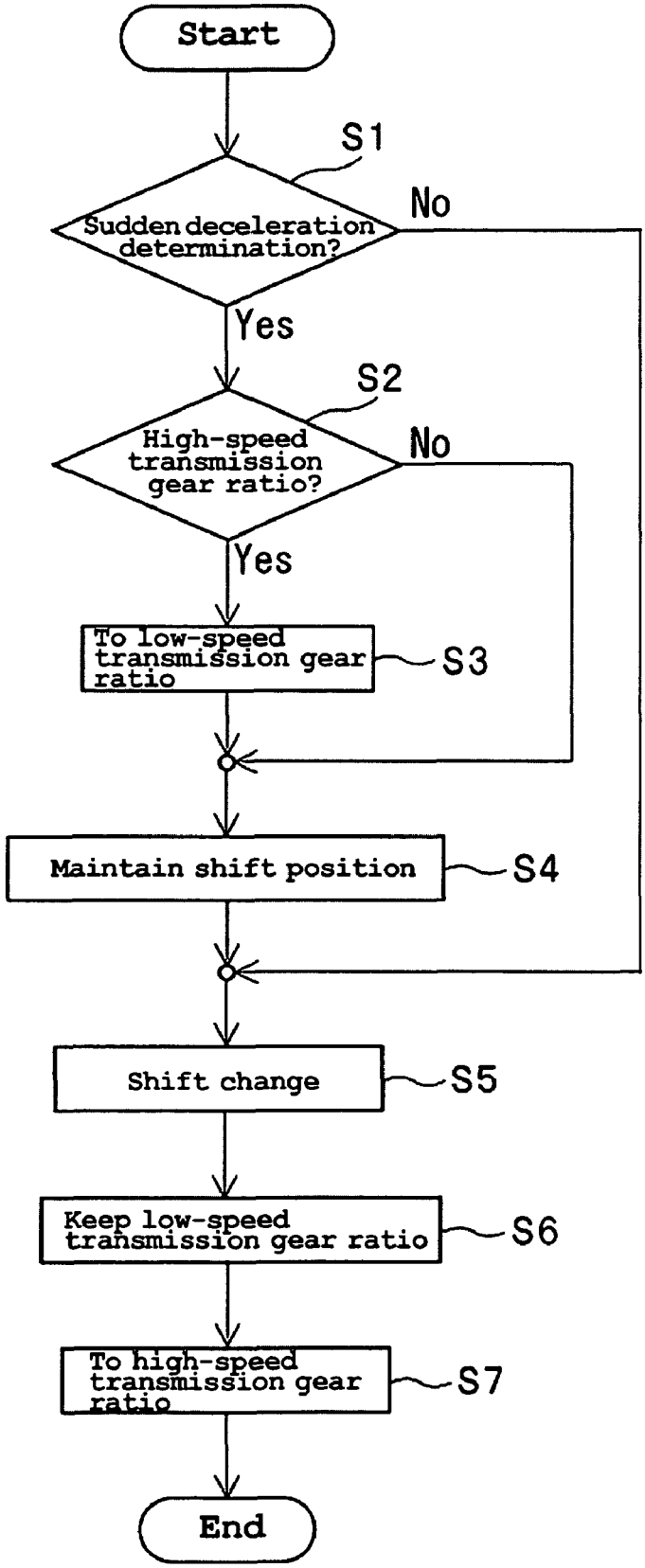
FIG. 7 is a flow chart showing the control at the time when a shift change operation is performed from one of forward and reverse to the other.

(1) Control at the Time when a Shift Change Operation from One of Forward and Reverse to the Other is Performed In the present preferred embodiment, when a shift change operation from one of forward and reverse to the other is performed, control shown in FIG. 7 is performed. Here, the "shift change operation from one of forward and reverse to the other" includes at least two types of cases described below. A first operation is the case where a shift change operation is continuously performed from one of forward and reverse to the other. A second operation is the case where a shift change operation is temporarily performed from one of forward and reverse to neutral, and the control lever is maintained in the neutral position for a predetermined period of time, for about 10 seconds, for example, before a shift change operation is performed from one of forward and reverse to the other. In other words, the "shift change operation from one of forward and reverse to the other" includes a shift change operation in which neutral is maintained for a predetermined period of time, for about 10 seconds, for example.

As shown in FIG. 7, when a shift change operation from one of forward and reverse to the other is performed, a sudden deceleration determination is performed in step 1. Here, the "sudden deceleration determination" refers to determining whether or not an accelerator opening varying speed is equal to or higher than a predetermined speed. The accelerator opening varying speed is obtained by differentiating the accelerator opening detected by the accelerator opening sensor 84 shown in FIG. 5 with respect to time.

Figure 8:
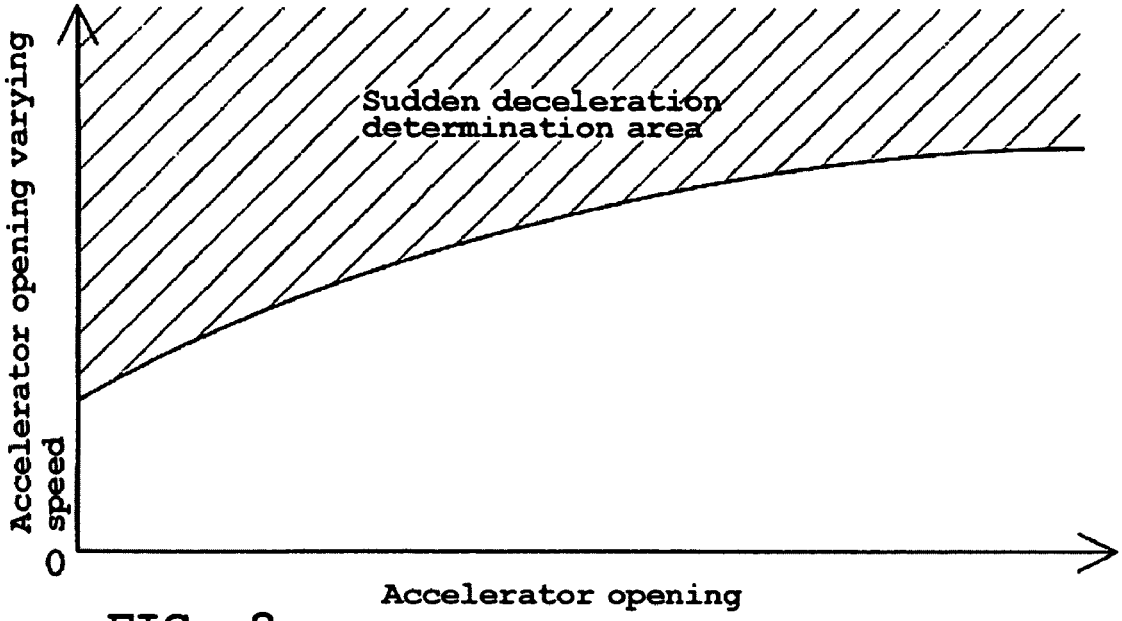
FIG. 8 is a map of the accelerator openings and the accelerator opening varying speed showing a sudden deceleration determination area.

Specifically, the sudden deceleration determination is performed on the basis of a sudden deceleration determination map shown in FIG. 8. As shown in FIG. 8, an area in which the accelerator opening varying speed is equal to or larger than a predetermined value relative to the accelerator opening is set as a sudden deceleration determination area. When the accelerator opening and the accelerator opening varying speed detected by the accelerator opening sensor 84 are plotted in the sudden deceleration determination map and if the plotted point belongs to the sudden deceleration determination area, the plotted point is determined as the sudden deceleration. On the other hand, if the plotted point does not belong to the sudden deceleration determination area, it is not determined as the sudden deceleration.

Specifically, the sudden deceleration determination map is stored in the memory 86*b* shown in FIG. 5. In step S1, if a signal indicating that a shift change operation from one of forward and reverse to the other is performed is output from the shift position sensor 85 to the CPU 86*a*, the CPU 86*a* acquires the present accelerator opening and the accelerator opening varying speed from the accelerator opening signal output from the accelerator opening sensor 84. The CPU 86*a* reads out the sudden deceleration determination map from the memory 86*b*. The CPU 86*a* plots the acquired present accelerator opening and the accelerator opening varying speed in the sudden deceleration determination map to determine whether or not the plotted point belongs to the sudden deceleration determination area. If it is determined that the plotted point belongs to the sudden deceleration determination area, the CPU 86*a* recognizes the "sudden deceleration." In this case, the procedure goes to step S2. On the other hand, if it is determined that the plotted point does not belong to the sudden deceleration determination area, the CPU 86*a* recognizes that "this is not the sudden deceleration." In this case, steps S2 to S4 are not performed, but the procedure goes to step S5.

In step S2, the CPU 86*a* determines whether or not a transmission gear ratio of the transmission gear ratio change mechanism 35 shown in FIGS. 1 to 3 is the high-speed transmission gear ratio. If it is determined in step S2 that it is the high-speed transmission gear ratio of the transmission gear ratio change mechanism 35, the procedure goes to step S3. On the other hand, if it is determined in step S2 that it is the low-speed transmission gear ratio of the transmission gear ratio change mechanism 35, step S3 is not performed, but the procedure goes to step S4.

The transmission gear ratio of the transmission gear ratio change mechanism 35 is changed from the high-speed transmission gear ratio to the low-speed transmission gear ratio in step S3. Specifically, the CPU 86*a* shown FIG. 5 operates the transmission gear ratio change electromagnetic valve 72 to disengage the transmission gear ratio change hydraulic clutch 53 shown in FIG. 3. As a result, the transmission gear ratio of the transmission gear ratio change mechanism 35 is changed from the high-speed transmission gear ratio to the low-speed transmission gear ratio.

The shift position is maintained in step S4 until propeller rotational speed detected by the propeller rotational speed sensor 90 shown FIG. 5 becomes equal to or lower than a predetermined rotational speed. In other words, a shift change is not started until the propeller rotational speed detected by the propeller rotational speed sensor 90 becomes equal to or lower than the predetermined rotational speed. The "predetermined rotational speed" can be appropriately set according to characteristics and so forth of the boat 1 and the outboard motor 20. The "predetermined rotational speed" can be set to about 300 rpm to about 5000 rpm, for example.

After the propeller rotational speed is set to the predetermined rotational speed or lower in step S4, a shift change is performed from one side of forward and reverse to the other side in step S5. If it is not determined as the sudden deceleration in step S1, maintaining the shift position shown in step S4 is not performed, but a shift change is performed in step S5.

If a shift change operation of the control lever 83 is performed from one of forward and reverse to the shift position of the other low-speed transmission gear ratio, a shift change is performed to the shift position of the other low-speed transmission gear ratio of forward or reverse in step S5. In addition, if a shift change operation of the control lever 83 is performed from one of forward and reverse to the shift position of the other high-speed transmission gear ratio, a shift change is temporarily performed to the shift position of the other low-speed transmission gear ratio of forward or reverse. In other words, a shift change is temporarily performed to low-speed forward or low-speed reverse regardless of the transmission gear ratio of a target shift position in step S5.

If the target shift position is the low-speed transmission gear ratio, the procedure ends in step S5. On the other hand, if the target shift position is the high-speed transmission gear ratio, step S6 is performed after step S5 as shown in FIG. 7.

The low-speed transmission gear ratio is kept for a predetermined period in step S6. Here, the "predetermined period" in step S6 is, for example, about 0.5 second to about 30 seconds and preferably about 5 seconds to about 10 seconds, for example.

After step S6, step S7 is performed. The transmission gear ratio of the transmission gear ratio change mechanism 35 is changed from the low-speed transmission gear ratio to the high-speed transmission gear ratio in step S7.

(2) When a Shift Change Operation is Performed from Neutral to Forward or Reverse For example, when neutral is set, if the transmission gear ratio of the transmission gear ratio change mechanism 35 is the high-speed transmission gear ratio, the transmission gear ratio of the transmission gear ratio change mechanism 35 is changed from the high-speed transmission gear ratio to the low-speed transmission gear ratio first. After this, the shift position of the shift position change mechanism 36 is changed from neutral to forward or reverse. In other words, a shift change from neutral to forward or reverse is started after the transmission gear ratio of the transmission gear ratio change mechanism 35 has been changed to the low-speed transmission gear ratio. After this, the transmission gear ratio of the transmission gear ratio change mechanism 35 is changed from the low-speed transmission gear ratio to the high-speed transmission gear ratio.

A specific description will be given with reference to examples of the cases shown in FIGS. 9, 10 and FIGS. 11, 12.

Figure 9:
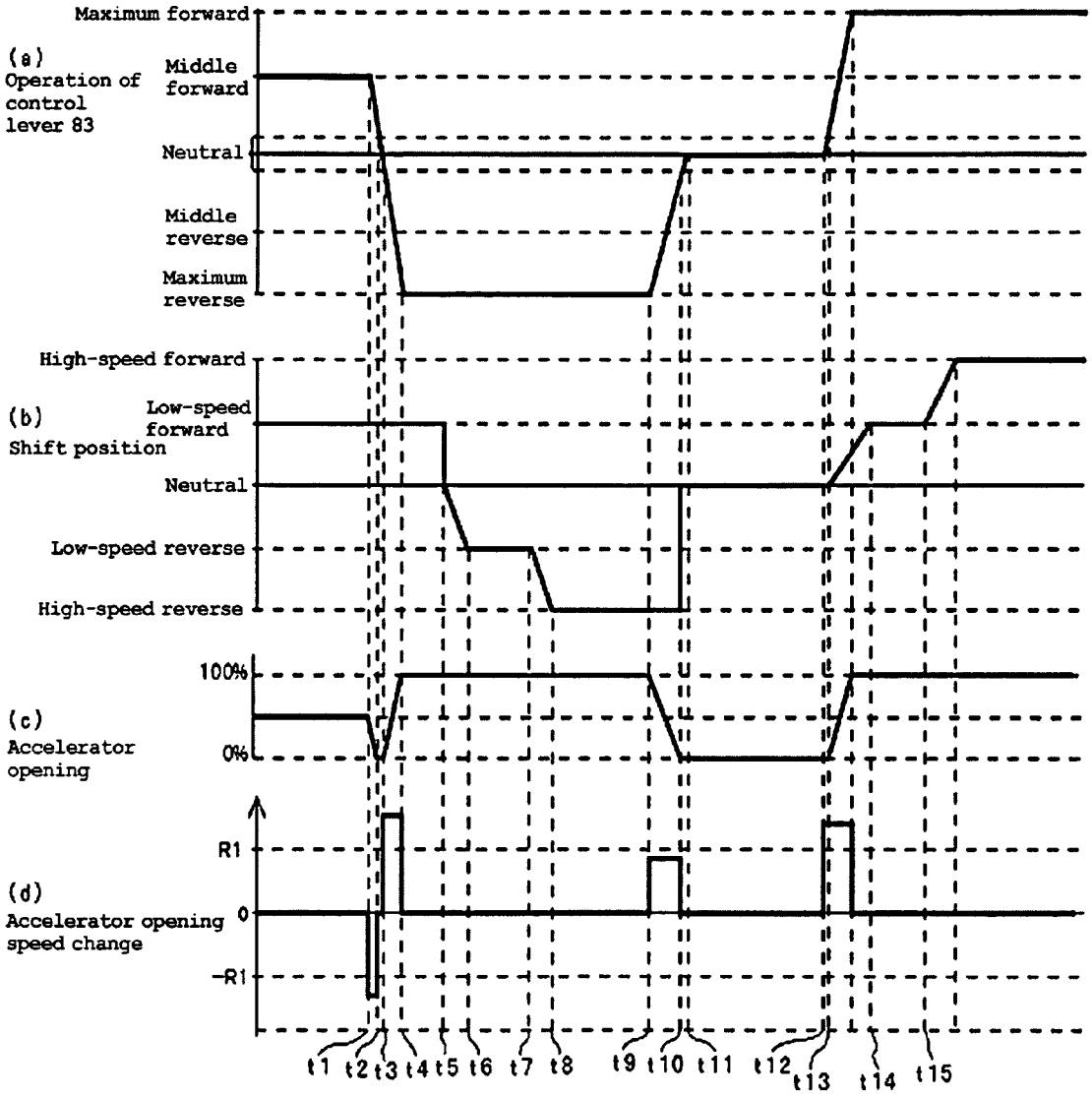
FIG. 9 is a graph showing a first example of changes of a control lever operation, the shift position, a transmission ear ratio change hydraulic clutch, and a first and a second shift change hydraulic clutches, wherein (a) is a graph showing the change of the control lever operation, (b) is a graph showing the change of the shift position, (c) is a graph showing the change of the accelerator opening, and (d) is a graph showing the change of a varying speed of the accelerator opening.
Figure 10:
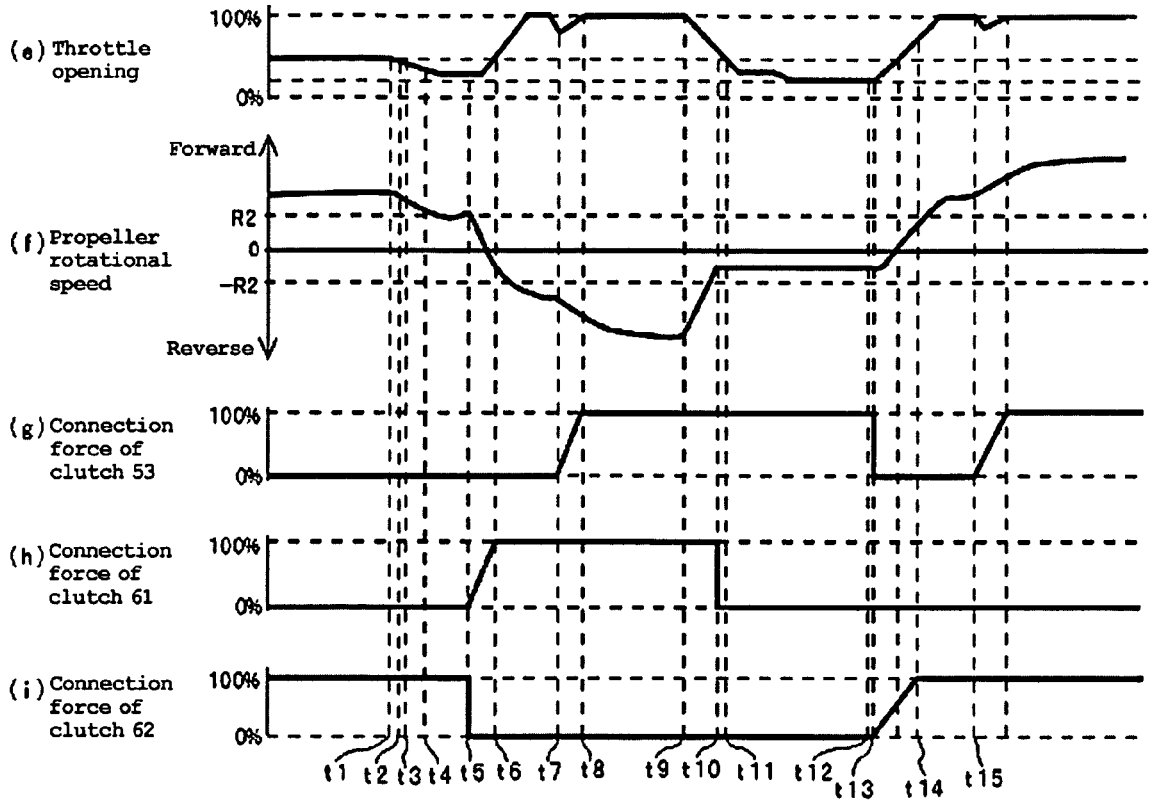
FIG. 10 is a graph showing the first example of changes of the control lever operation, the shift position, the transmission gear ratio change hydraulic clutch, and the first and the second shift change hydraulic clutches, wherein (e) is a graph showing the change of the throttle opening, (f) is a graph showing the change of the propeller rotational speed, (g) is a graph showing the change of the connection force of the transmission gear ratio change hydraulic clutch, (h) is a graph showing the change of the connection force of the first shift change hydraulic clutch, and (i) is a graph showing the change of the connection force of the second shift change hydraulic clutch.

As shown in FIG. 9(*a*), a shift change operation from low-speed forward to high-speed reverse is performed at time t1 in the case shown in FIG. 9 and FIG. 10. As shown in FIG. 9(*d*), the absolute value of the accelerator opening varying speed based on the shift change operation at time t1 to t4 is larger than a predetermined amount R1. Therefore, the "sudden deceleration" is recognized in step S1 shown in FIG. 7. Therefore, as shown in FIG. 10(*i*), even when a position of the control lever 83 reaches the neutral area at time t2, the second shift change hydraulic clutch 62 is not disengaged. The engaged state of the second shift change hydraulic clutch 62 is maintained. Accordingly, as shown in FIG. 9(*b*), the shift position is kept to low-speed forward even at time t2.

If the sudden deceleration recognized in step S1, the throttle opening is controlled not to follow a change in the accelerator opening as shown in FIG. 9(*c*) and FIG. 10(*e*). Specifically, even if the accelerator opening increases, the throttle opening is controlled not to increase. Accordingly, as shown in FIG. 10(*f*), the propeller rotational speed is decreased from time t2.

In the example shown in FIG. 9 and in FIG. 10, the propeller rotational speed is decreased to the predetermined rotational speed R2 at time t5 as shown in FIG. 10(*f*). Accordingly, as shown in FIG. 9(*b*), the shift position is maintained at low-speed forward from time t2 to time t5. Moreover, as shown in FIG. 10(*i*), the second shift change hydraulic clutch 62 is disengaged at time t5. As a result, the shift position becomes neutral at time t5.

At the same time, as shown in FIG. 10(*h*), engagement of the first shift change hydraulic clutch 61 is started at time t5. As a result, as shown in FIG. 9(*b*), the shift position becomes low-speed reverse at time t6. After this, as shown in FIG. 9(*b*), the shift position is maintained at low-speed reverse from time t6 to t7.

Engagement of the first shift change hydraulic clutch 61 is started at time t5. From this time, as shown in FIG. 9(*c*) and FIG. 10(*e*), the throttle opening is controlled to gradually follow the accelerator opening. Accordingly, as shown in FIG. 10(*e*), the throttle opening angle gradually increases after time t5 toward the throttle opening angle corresponding to the accelerator opening. As a result, as shown in FIG. 10(*f*), the propeller rotational speed is significantly decreased.

As shown in FIG. 10(*g*), engagement of the transmission gear ratio change hydraulic clutch 53 is started at time t7. As a result, as shown in FIG. 9(*b*), the shift position becomes high-speed reverse at time t8.

As shown in FIG. 10(*e*), a shift change is performed from low-speed reverse to high-speed reverse from time t7 to time t8. In this period, the throttle opening is controlled to be somewhat decreased regardless of the fact that the accelerator opening is unchanged. As a result, a shock applied to the boat 1 at the time of a shift change from low-speed reverse to high-speed reverse is greatly reduced.

In the example shown in FIG. 9 and in FIG. 10, the shift change operation from high-speed reverse to neutral is performed at time t9 as shown in FIG. 9(*a*). Accordingly, as shown in FIG. 10(*h*), the first shift change hydraulic clutch 61 is disengagement at time t10 when the position of the control lever 83 reaches the neutral area. As a result, as shown in FIG. 9(*b*), the shift position becomes neutral from time t10.

In the example shown in FIG. 9 and in FIG. 10, a shift change operation is performed form neutral to high-speed forward at time t12 as shown in FIG. 9(*a*). Here, as shown in FIG. 10(*g*), the transmission gear ratio change hydraulic clutch 53 is engaged at time t12. Accordingly, the transmission gear ratio of the transmission gear ratio change mechanism 35 is at the high-speed transmission gear ratio at time t12. Accordingly, as shown in FIG. 10(*g*), the transmission gear ratio change hydraulic clutch 53 is disengaged at time t13 first. As a result, the transmission gear ratio of the transmission gear ratio change mechanism 35 becomes the low-speed transmission gear ratio. Moreover, as shown in FIG. 10(*i*), engagement of the second shift change hydraulic clutch 62 is started at time t13. As a result, as shown in FIG. 9(*b*), the shift position becomes low-speed forward at time t14.

As shown in FIG. 9(*b*), low-speed forward is maintained from time t14 to t15. Moreover, as shown in FIG. 10(*g*), engagement of the transmission gear ratio change hydraulic clutch 53 is started at time t15. As a result, as shown in FIG. 9(*b*), the shift position becomes high-speed forward at time t16.

Figure 11:
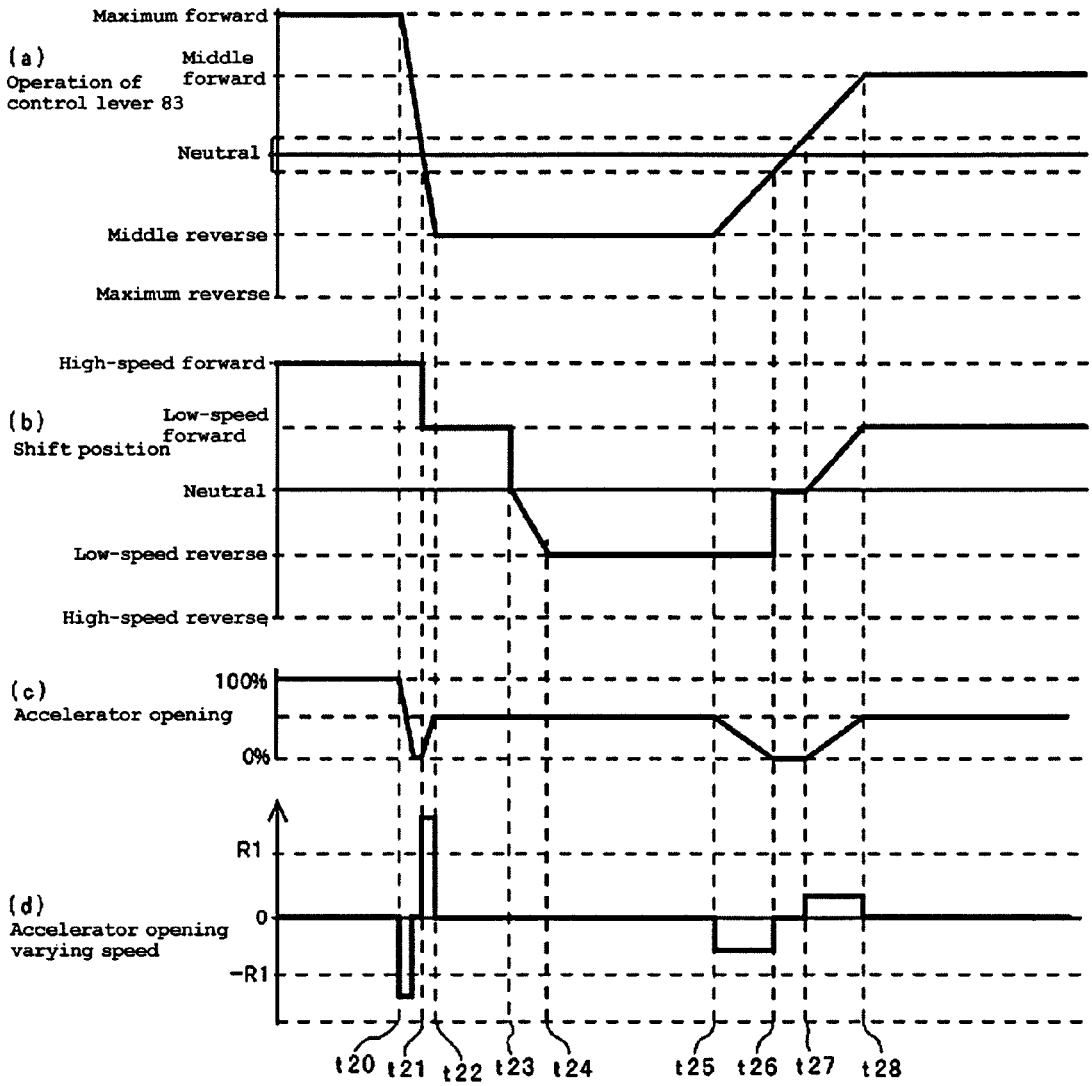
FIG. 11 is a graph showing a second example of changes of the control lever operation, the shift position, the transmission gear ratio change hydraulic clutch, and the first and the second shift change hydraulic clutches, wherein (a) is a graph showing the change of the control lever operation, (b) is a graph showing the change of the shift position, (c) is a graph showing the change of the accelerator opening, and (d) is a graph showing the change of the varying speed of the accelerator opening.

An example shown in FIG. 11 and in FIG. 12 will be described hereinafter. In the example shown in FIG. 11 and in FIG. 12, a shift change operation is performed form high-speed forward to low-speed reverse at time t20 as shown in FIG. 11(*a*). Here, the absolute value of the accelerator opening varying speed from time t20 to t22 is equal to or higher than the predetermined amount R1 shown in FIG. 11(*d*). Accordingly, as shown in FIG. 11(*i*), the second shift change hydraulic clutch 62 is not disengaged even at time t21 when the position of the control lever 83 reaches the neutral area. Accordingly, as shown in FIG. 11(*b*), the shift position is maintained in forward at time t21. However, the transmission gear ratio of the transmission gear ratio change mechanism 35 is the high-speed transmission gear ratio at time t21. Accordingly, as shown in FIG. 11(*g*), the transmission gear ratio change hydraulic clutch 53 is disengaged at time t21. Accordingly, the high-speed transmission gear ratio is changed to the low-speed transmission gear ratio at time t21. However, as described above, the throttle opening is controlled to be decreased. Therefore, as shown in FIG. 12(*f*), the propeller rotational speed is decreased from time t20.

Figure 12:
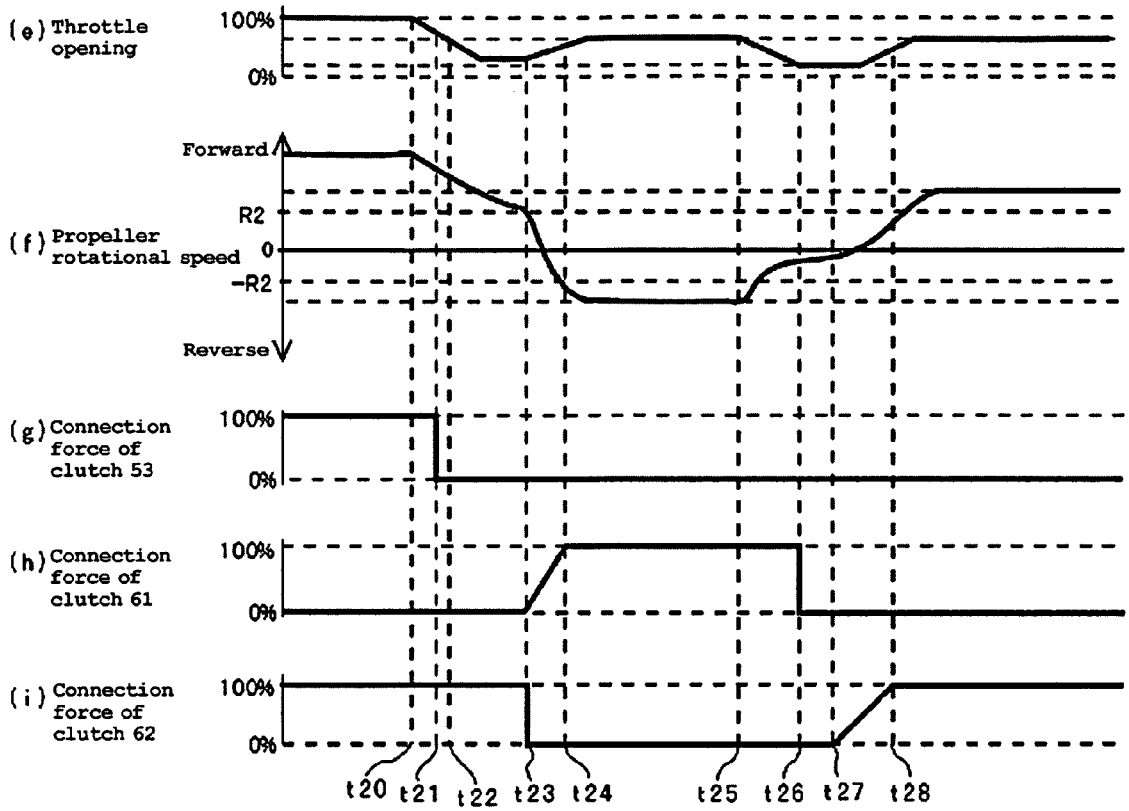
FIG. 12 is a graph showing the second example of changes of the control lever operation, the shift position, the transmission gear ratio change hydraulic clutch, and the first and the second shift change hydraulic clutches, wherein (e) is a graph showing the change of the throttle opening, (f) is a graph showing the change of the propeller rotational speed, (g) is a graph showing the change of the connection force of the transmission gear ratio change hydraulic clutch, (h) is a graph showing the change of the connection force of the first shift change hydraulic clutch, and (i) is a graph showing the change of the connection force of the second shift change hydraulic clutch.

In the example shown in FIG. 11 and in FIG. 12, as shown in FIG. 12(*f*), the propeller rotational speed becomes smaller than the predetermined rotational speed R2 at time t23. Accordingly, as shown in FIG. 12(*h*) and in FIG. 12(*i*), the second shift change hydraulic clutch 62 is disengaged at time t23. At the same time, engagement of the first shift change hydraulic clutch 61 is started. As a result, as shown in FIG. 11(*b*), the shift position becomes low-speed reverse at time t24.

In the example shown in FIG. 11 and in FIG. 12, as shown in FIG. 11(*a*), a shift change operation is performed from low-speed reverse to low-speed forward at time t25. However, as shown in FIG. 11(*d*), the absolute value of the accelerator opening varying speed from time t25 to t28 is less than the predetermined amount R1. Accordingly, maintaining the shift position shown in step S4 in FIG. 7 is not performed. Accordingly, as shown in FIG. 12(*h*), the first shift change hydraulic clutch 61 is disengaged at time t26. As shown in FIG. 12(*i*), engagement of the second shift change hydraulic clutch 62 is started at time t27. As a result, as shown in FIG. 11(*b*), the shift position becomes low-speed forward at time t28.

(3) Gradual Increase in the Connection Force of the First Shift Change Hydraulic Clutch 61 and the Second Shift Change Hydraulic Clutch 62

In the present preferred embodiment, when a shift change is performed to forward or to reverse, the connection force of the first shift change hydraulic clutch 61 or the second shift change hydraulic clutch 62 is gradually increased. Therefore, the first shift change hydraulic clutch 61 or the second shift change hydraulic clutch 62 is slowly engaged.

For example, in the example shown in FIG. 7, the connection force of the first shift change hydraulic clutch 61 is gradually increased at time t5. The connection force of the second shift change hydraulic clutch 62 is gradually increased at time t13.

Specifically, the shift position sensor 85 sends a shift position signal of forward to the control device 86 via the LAN 80 at time t13 in the example shown in FIG. 7.

Figure 13:
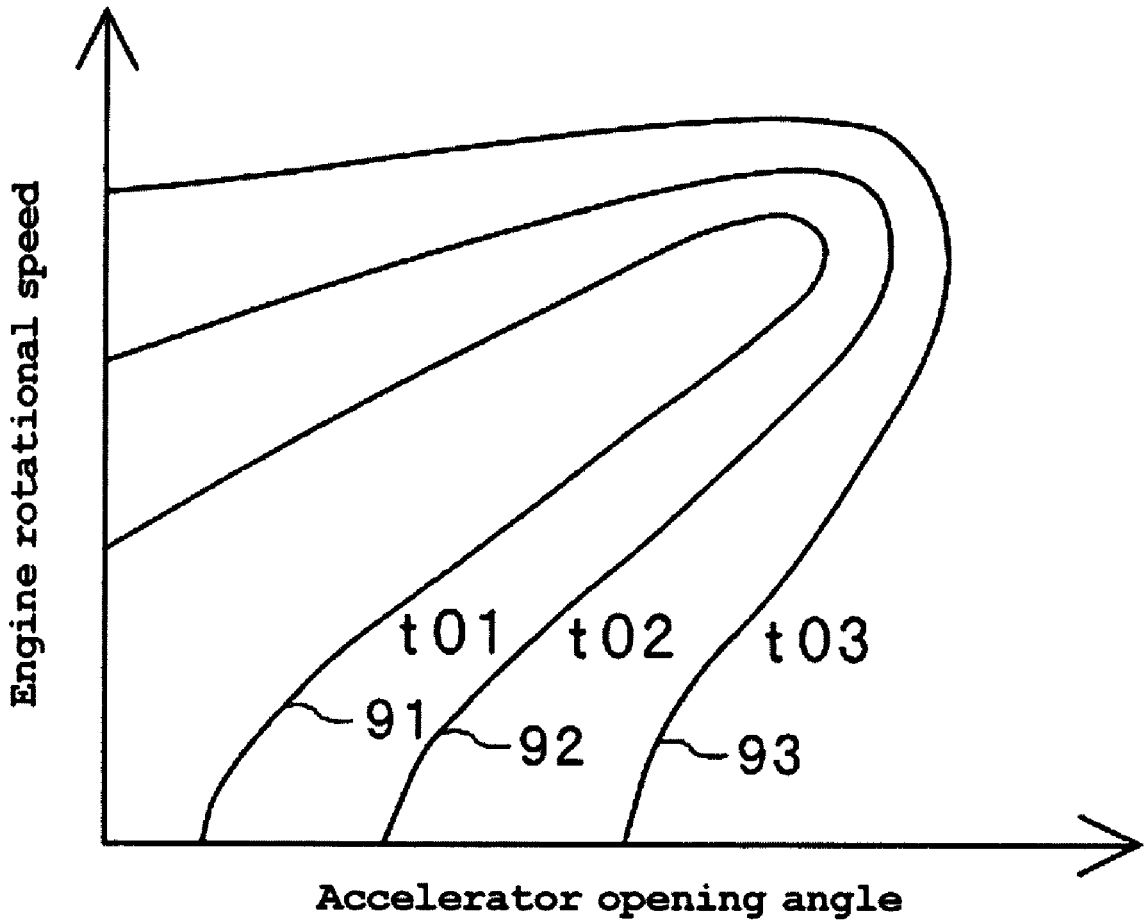
FIG. 13 is a map showing the accelerator openings, the engine rotational speed, and the clutch engaging time.

The CPU 86*a* reads out a map shown in FIG. 13 stored in the memory 86*b* first. The map shown in FIG. 13 is a map that shows the accelerator openings, the engine rotational speed, and the clutch engaging time. The CPU 86*a* determines engaging time of the second shift change hydraulic clutch 62 on the basis of FIG. 13. In other words, the engaging time of the second shift change hydraulic clutch 62 is determined on the basis of the engine rotational speed and the accelerator opening.

Here, the "engaging time" of the clutch is the time elapsed between the start of clutch engagement and completion of the clutch engagement. Further specifically, the "engaging time" of the clutch is the time elapsed from the start of clutch engagement until the time when the output shaft rotates at the same speed as the input shaft.

In the present preferred embodiment, the "start of clutch engagement" refers to a start of driving the actuator to engage or disengage the hydraulic clutch.

Specifically, the engaging time of the second shift change hydraulic clutch 62 is derived by applying the accelerator opening and the engine rotational speed immediately before the start of engagement of the second shift change hydraulic clutch 62 to the map shown in FIG. 13. For example, when the accelerator opening and the engine rotational speed immediately before the start of engagement of the second shift change hydraulic clutch 62 are plotted in FIG. 13 and the plotted point is positioned if between a line 91 and a line 92, then engaging time t01 is derived. Also, when the accelerator opening and the engine rotational speed immediately before the start of engagement of the second shift change hydraulic clutch 62 are plotted in FIG. 13 and if the plotted point is positioned between the line 92 and a line 93, then engaging time t02 is derived. When the accelerator opening and the engine rotational speed immediately before the start of engagement of the second shift change hydraulic clutch 62 are plotted in FIG. 13 and if the plotted point is positioned outside the line 93, then engaging time t03 is derived. Here, t01<t02<t03.

Figure 14:
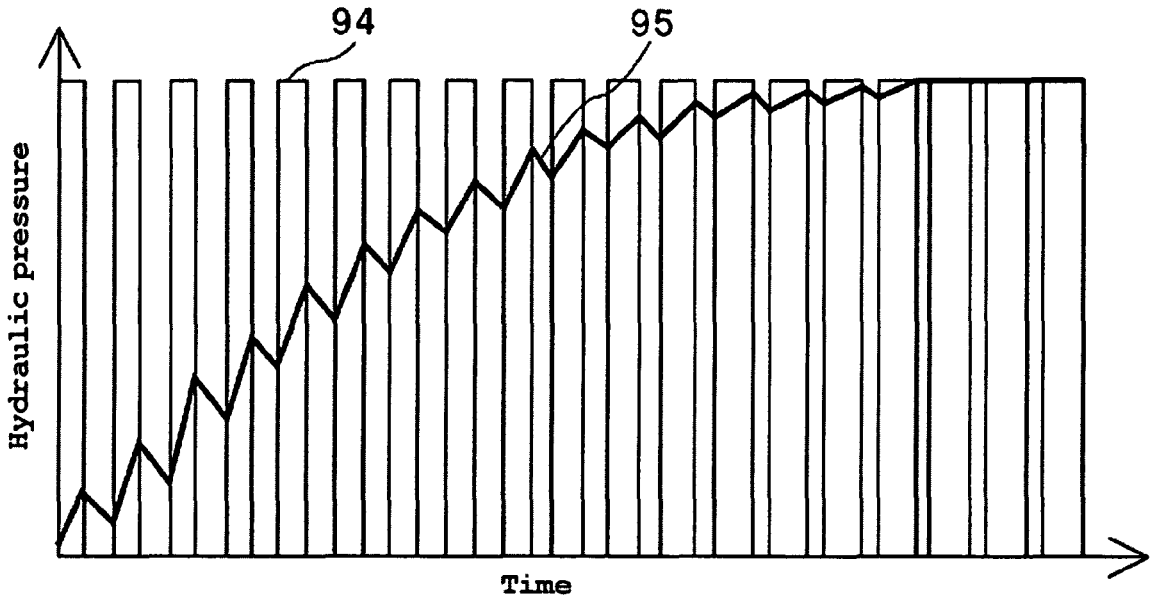
FIG. 14 is a graph showing a PWM signal and hydraulic pressure output to a forward shift connection electromagnetic valve in the case where the second hydraulic clutch is engaged at time t03.

The CPU 86*a* controls the forward shift connection electromagnetic valve 74 to engage the second shift change hydraulic clutch 62 in the derived engaging time. Specifically, for example, if engaging time t03 is derived, as shown in FIG. 14 and in FIG. 15, the CPU 86*a* gradually increases the hydraulic pressure of the hydraulic piston 62*a* shown in FIG. 3 to cause the second shift change hydraulic clutch 62 to be completely engaged after time t03. More specifically, as shown in FIG. 14, the CPU 86*a* gradually increases the duty ratio of a duty-cycle signal output to the forward shift connection electromagnetic valve 74 to set the duty ratio to 100% after time t03. Consequently, the hydraulic pressure of the hydraulic piston 62*a* is gradually increased. As a result, the connection force of the second shift change hydraulic clutch 62 is gradually increased. A line 94 shown in FIG. 14 denotes the duty-cycle signal output to the forward shift connection electromagnetic valve 74. Further, a thick line 95 denotes the hydraulic pressure of the second shift change hydraulic clutch 62.

Figure 15:
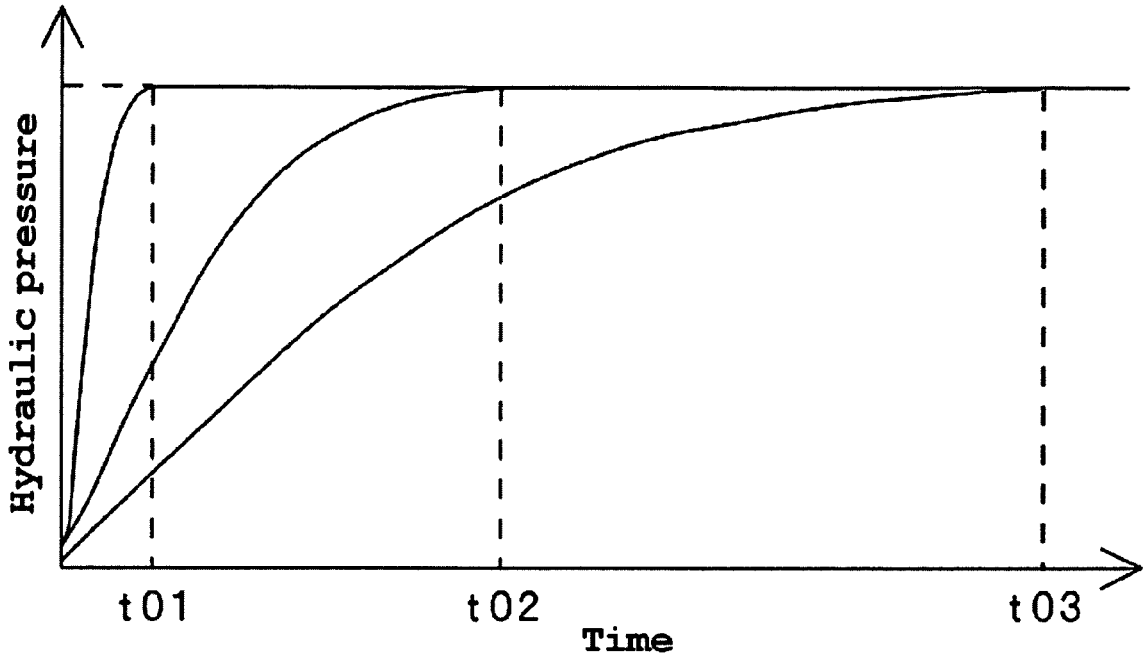
FIG. 15 is a graph showing the change of hydraulic pressure of the second hydraulic clutch in the case where the engaging time is t01, t02, and t03.

On the other hand, for example, if engaging time t02 is derived, as shown in FIG. 15, the hydraulic pressure of the hydraulic piston 62*a* shown in FIG. 3 is gradually increased to cause the second shift change hydraulic clutch 62 to be completely engaged after time t02. For example, if engaging time t01 is derived, as shown in FIG. 15, the hydraulic pressure of the hydraulic piston 62*a* shown in FIG. 3 is gradually increased to cause the second shift change hydraulic clutch 62 to be completely engaged after time t01.

Description is given with reference to FIG. 14 and FIG. 15 of an example where the connection force is gradually increased during a period of time from the start of clutch engagement of the first shift change hydraulic clutch 61 or the second shift change hydraulic clutch 62 to completion of engagement. More specifically, description is given of an example where the connection force of the clutch is gradually changed such that the varying speed of the connection force of the clutch is gradually decreased. However, the present invention is not limited to this particular example.

Figure 16:
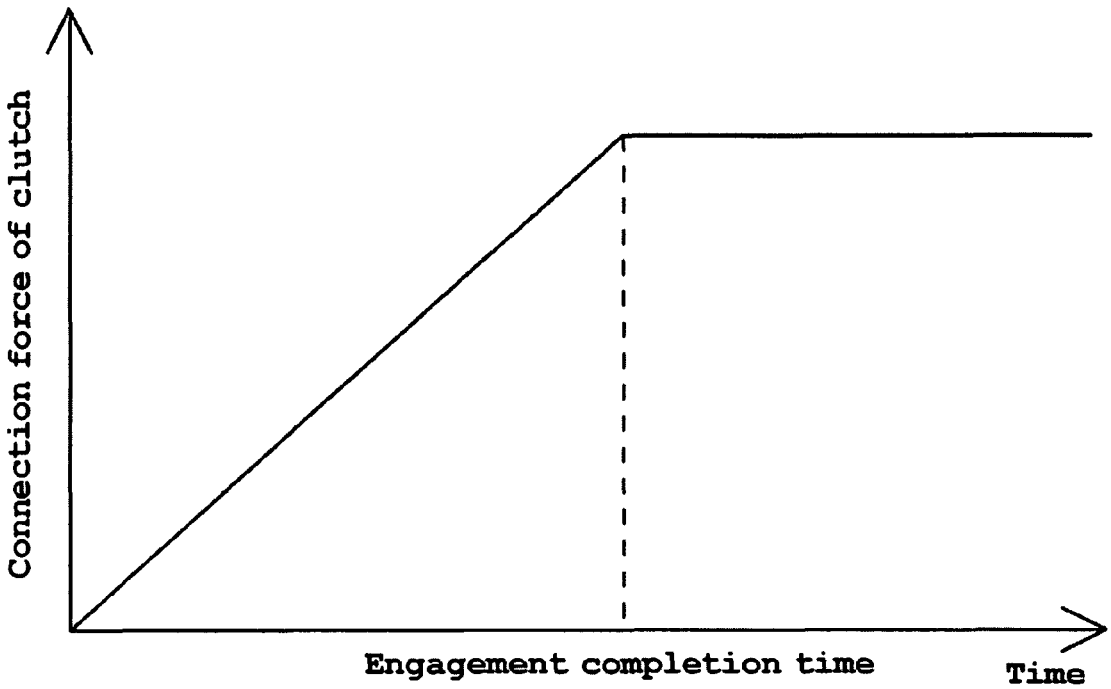
FIG. 16 is a graph showing the change of the connection force of the shift connection clutch at the time when a shift change is performed from neutral to forward or to reverse in a modification example 1.

For example, as shown in FIG. 16, the connection force may be is monotonously increased during the period of time from the start of clutch engagement of the first shift change hydraulic clutch 61 or the second shift change hydraulic clutch 62 to completion of engagement.

Figure 17:
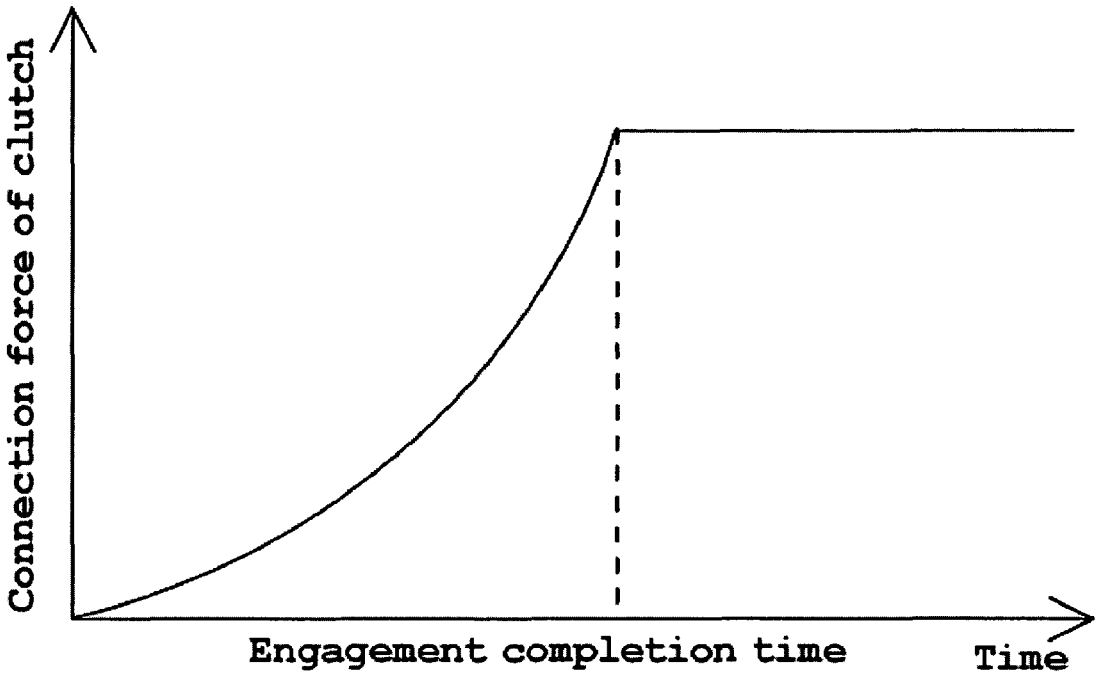
FIG. 17 is a graph showing the change of the connection force of the shift connection clutch at the time when a shift change is performed from neutral to forward or to reverse in a modification example 2.

As shown in FIG. 17, the connection force may be increased such that the varying speed of the connection force of the clutch is gradually increased during the period of time from the start of clutch engagement of the first shift change hydraulic clutch 61 or the second shift change hydraulic clutch 62 to completion of engagement.

Figure 18:
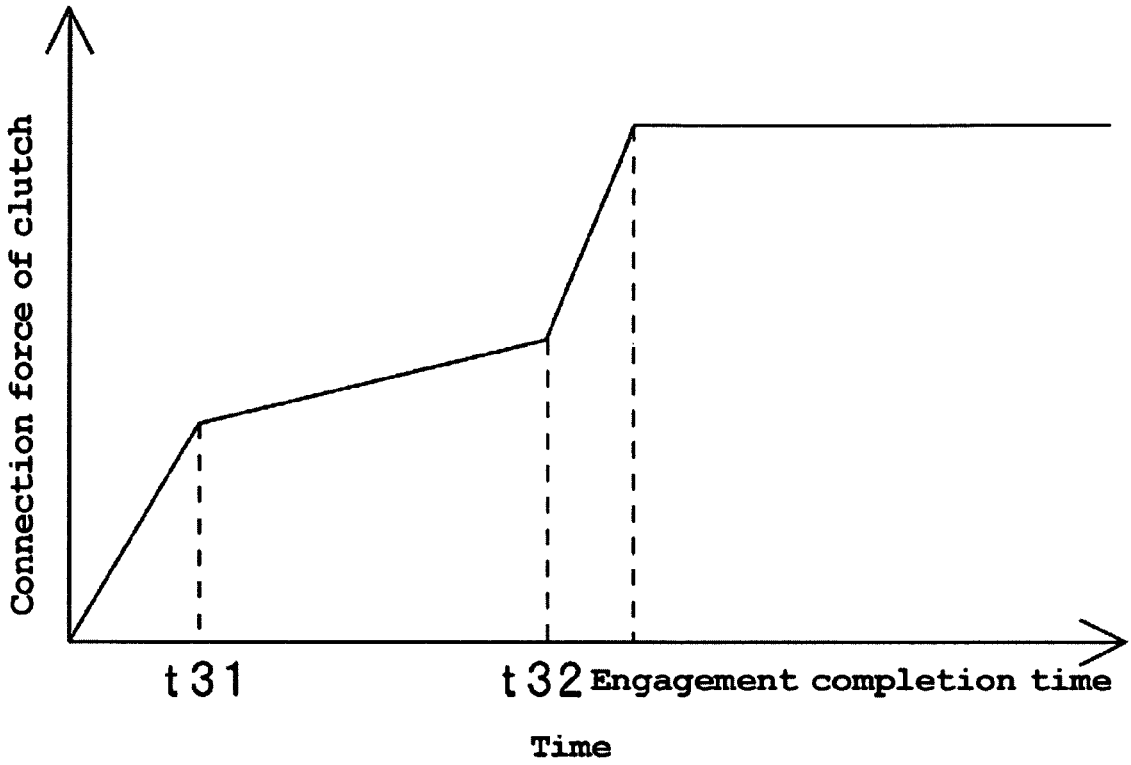
FIG. 18 is a graph showing the change of the connection force of the shift connection clutch at the time when a shift change is performed from neutral to forward or to reverse in a modification example 3.

Further, as shown in FIG. 18, the connection force of the first shift change hydraulic clutch 61 or the second shift change hydraulic clutch 62 may be gradually increased only during a period from t31 to t32, which is a portion of the period of time from the start of clutch engagement of the first shift change hydraulic clutch 61 or the second shift change hydraulic clutch 62 to completion of engagement. In other words, the connection force may be suddenly increased during a portion of the period of time from the start of clutch engagement of the first shift change hydraulic clutch 61 or the second shift change hydraulic clutch 62 to completion of engagement.

Figure 19:
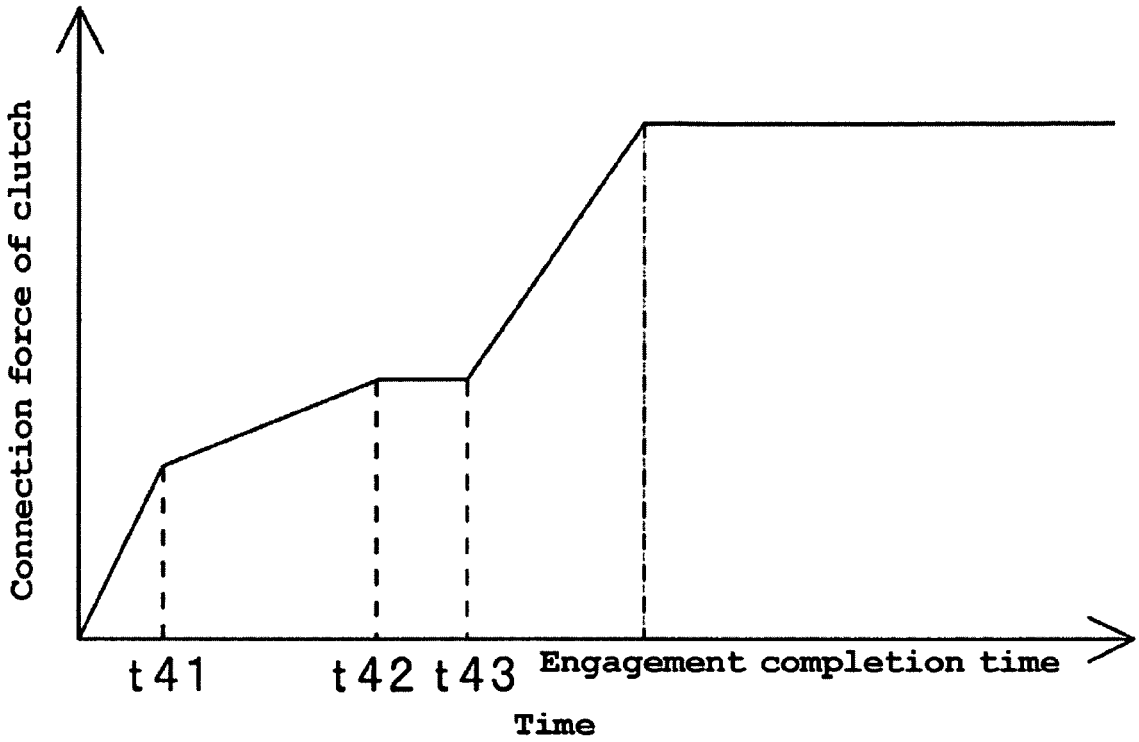
FIG. 19 is a graph showing the change of the connection force of the shift connection clutch at the time when a shift change is performed from neutral to forward or to reverse in a modification example 4.

Moreover, as shown in FIG. 19, the connection force may be constantly maintained during the period from t42 to t43, which is a portion of the period of time from the start of clutch engagement of the first shift change hydraulic clutch 61 or the second shift change hydraulic clutch 62 to completion of engagement. Specifically, the connection force is gradually changed during the period from t41 to t42, which is a portion of the period of time from the start of clutch engagement of the first shift change hydraulic clutch 61 or the second shift change hydraulic clutch 62 to completion of engagement. Then, the connection force is constantly maintained during the period from t42 to t43. Moreover, the connection force may be suddenly increased from t43.

Thus, it is possible to appropriately determine how the connection force of the shift change clutches 61, 62 is gradually increased on the basis of the characteristics of the clutches 61, 62 and the characteristics of the outboard motor 20 and the boat 1 and the like.

As described above, in the present preferred embodiment, when a shift change operation is performed from one of forward and reverse to the other, and, at the same time, if the accelerator opening varying speed is equal to or higher than the predetermined speed, then the shift position is maintained until the propeller rotational speed becomes equal to or lower than the predetermined rotational speed. Then, a shift change is performed. Therefore, the propeller rotational speed at the time of a shift change can be reduced. Accordingly, it is possible to reduce load applied on the engine 30, the power transmission mechanism 32, and so forth at the time of a shift change. As a result, it is possible to improve durability of the engine 30, the power transmission mechanism 32, and so forth.

Further, in order to reduce the propeller rotational speed at the time of a shift change, it is also possible, for example, to maintain neutral until the propeller rotational speed reduces after temporarily changing to neutral. However, in this case, a rotational load applied to the propeller 41 is decreased. Therefore, it takes a long time until the propeller rotational speed is decreased. Therefore, the time required for a shift change also becomes long. On the other hand, in the preferred embodiment, it is possible to decrease the propeller rotational speed in a state where the shift position is maintained at forward or reverse. Therefore, the rotational load applied to the propeller 41 becomes large. Accordingly, it is possible to decrease the propeller rotational speed in a short time. As a result, a prompt shift can be made.

As descried above, according to the preferred embodiment, it is possible to reduce the load that is applied to the engine 30, the power transmission mechanism 32, and so forth while the time required for a shift change is suppressed.

In particular, in the present preferred embodiment, when a shift change is performed from high-speed forward or from high-speed reverse, the shift position is maintained at low-speed forward or at low-speed reverse after the shift change is temporarily performed to low-speed forward or to low-speed reverse. Therefore, the rotational load applied to the propeller 41 becomes larger. Consequently, the decreasing speed of the rotational speed of the propeller 41 becomes high. Therefore, it is possible to more effectively suppress increase of the time required for the shift change.

In addition, when a shift change is performed to high-speed forward or to high-speed reverse, changing to the low-speed transmission gear ratio is performed prior to a shift-in to forward or to reverse. In other words, the transmission gear ratio at the time of the shift-in from neutral to forward is set to low speed. Therefore, when the shift change is performed to forward or to reverse, the load applied to the engine 30 and so forth can be reduced. Accordingly, it is possible to further improve durability of the engine 30, the power transmission mechanism 32, and so forth.

Further, in the present preferred embodiment, after the shift-in to forward or to reverse is completed, the transmission gear ratio of the transmission gear ratio change mechanism 35 is changed from low speed to high speed. In other words, after the shift change is temporarily performed from neutral to low-speed forward or to low-speed reverse, a shift change is performed from low-speed forward or from low-speed reverse to high-speed forward or to high-speed reverse. Accordingly, it is possible to reduce the load applied to the engine 30 and so forth at the time when a shift change is performed to forward or to reverse.

Further, in the present preferred embodiment, after the shift-in from neutral to forward is completed, the transmission gear ratio of the transmission gear ratio change mechanism 35 is maintained at low speed for the predetermined period. Accordingly, it is possible to further reduce the load applied to the engine 30 and so forth at the time when the shift change is performed to forward or to reverse.

Figure 20:
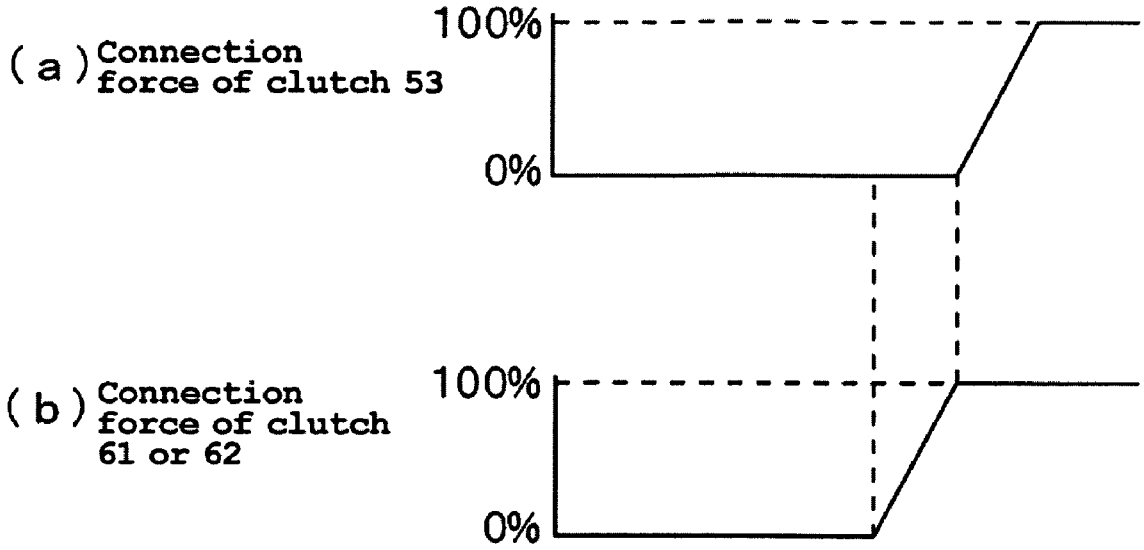
FIG. 20 is a time chart showing engagement timings of the transmission gear ratio change hydraulic clutch and the shift change hydraulic clutch in a modification example 5.

However, the present invention is not limited to the example of a preferred embodiment described above. For example, as shown in FIG. 20, when engagement of the first or the second shift change hydraulic clutch 61 or 62 is completed, engagement of the transmission gear ratio change hydraulic clutch 53 may be started at the same time. By doing so, the time required for the shift from neutral to high-speed forward or reverse can be reduced.

Figure 21:
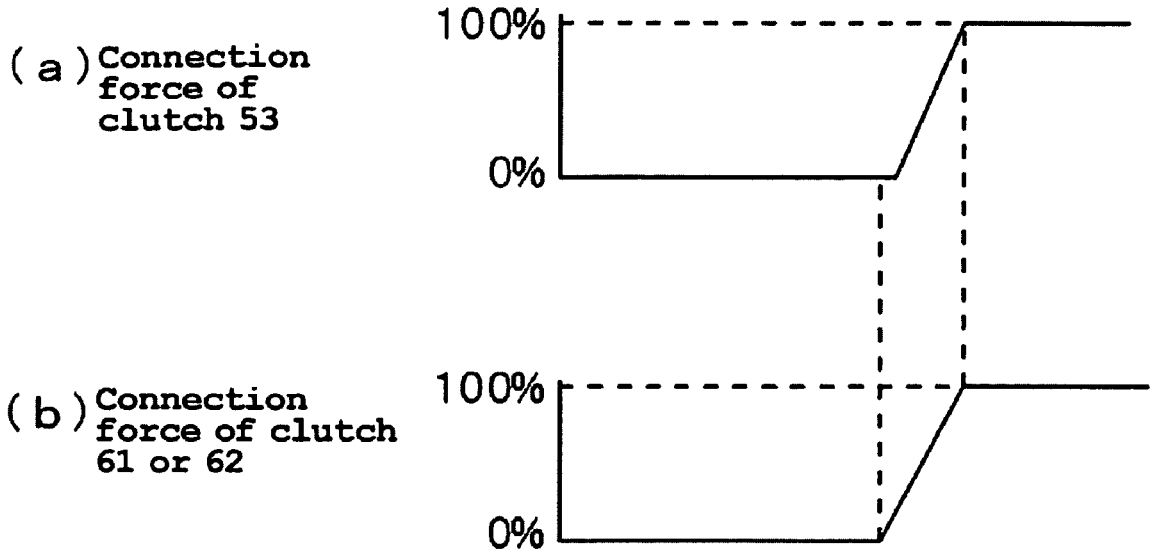
FIG. 21 is a time chart showing engaging timings of the transmission gear ratio change hydraulic clutch and the shift change hydraulic clutch in a modification example 6.

Further, as shown in FIG. 21, engagement of the transmission gear ratio change hydraulic clutch 53 may be started during a period of time from the start of clutch engagement of the first or the second shift change hydraulic clutch 61 or 62 to completion of engagement. By doing so, it is possible to reduce the time required for the shift change from neutral to high-speed forward or reverse.

In this case, the time at which engagement of the transmission gear ratio change hydraulic clutch 53 is completed may be earlier or later than the time at which engagement of the first or the second shift change hydraulic clutch 61 or 62 is completed. As shown in FIG. 21, the time at which engagement of the transmission gear ratio change hydraulic clutch 53 is completed may be substantially the same as the time at which engagement of the first or the second shift change hydraulic clutch 61 or 62 is completed.

In the present preferred embodiment, when a shift change is performed to high-speed forward or to high-speed reverse from the state where the shift position is neutral and the transmission gear ratio of the transmission gear ratio change mechanism 35 is the high-speed transmission gear ratio, the transmission gear ratio of the transmission gear ratio change mechanism 35 is temporarily changed to the low-speed transmission gear ratio prior to the shift change. Therefore, it is possible to reduce the load applied to the engine 30 and so forth at the time when the shift change is performed from neutral to forward or to reverse.

In the present preferred embodiment, when connection is made to forward or to reverse, the connection force of the first shift change hydraulic clutch 61 or the second shift change hydraulic clutch 62 is gradually increased. Therefore, the first shift change hydraulic clutch 61 or the second shift change hydraulic clutch 62 is slowly engaged. Accordingly, it is possible to reduce the load applied to the engine 30, the power transmission mechanism 32, the propulsion unit 33, and so forth.

Specific control of the boat 1 described in the present preferred embodiment does not need to be always performed in all operation states but only needs to be performed according to a situation of the boat 1 as necessary. Specifically, such a control only needs to be performed at least in a state where propulsion speed of the boat 1 is high, and load on the engine 30 is large at the same time.

For example, when the throttle opening is controlled to always follow the accelerator opening, the propeller rotational speed may not be decreased against an intent of the operator, and the propeller rotational speed may be increased in a rotational direction unexpected by the operator. Further, when the shift position is neutral, an abrupt increase of the engine rotational speed and the propeller rotational speed may be possible. On the other hand, in the present preferred embodiment, if the sudden deceleration is recognized, the throttle opening is controlled not to follow the change in the accelerator opening as described above. Therefore, it is possible to suppress or prevent an increase of the propeller rotational speed in a rotational direction unexpected by the operator and abrupt increase of the engine rotational speed and the propeller rotational speed at the time of the sudden deceleration.

In the present preferred embodiment described above, the map for controlling the transmission gear ratio change mechanism 35 and the map for controlling the shift position change mechanism 36 are stored in the memory 86*b* in the control device 86 mounted on the outboard motor 20. Also, the control signal for controlling the electromagnetic valves 72, 73, 74 is output from the CPU 86*a* in the control device 86 mounted on the outboard motor 20.

However, the present invention is not limited to the structure described above. For example, a memory as a storage device and a CPU as an operating unit may be provided in the controller 82 mounted on the hull 10 together with the memory 86*b* and the CPU 86*a* or instead of the memory 86*b* and the CPU 86*a*. In this case, the map for controlling the transmission gear ratio change mechanism 35 and the map for controlling the shift position change mechanism 36 may be stored in the memory provided on the controller 82. Also, the CPU provided on the controller 82 may output a control signal for controlling the electromagnetic valves 72, 73, 74.

In the preferred embodiment described above, the example where the control device 86 performs control of both the engine 30 and the electromagnetic valves 72, 73, 74 is described. However, the present invention is not limited to this example. For example, a control device that controls the engine and a control device that controls the electromagnetic valves may be separately provided.

In the preferred embodiment described above, the example where the controller 82 is a so-called "electronic control type controller" is described. Here, the "electronic control type controller" refers to a controller that converts an operating amount of the control lever 83 into an electrical signal and outputs the electrical signal to the LAN 80.

However, the controller 82 may not be an electronic control type controller in the present invention. For example, the controller 82 may be a so-called mechanical type controller. Here, the "mechanical type controller" refers to a controller provided with a control lever and a wire connected to the control lever in which an operating amount and an operating direction of the control lever is transmitted to an outboard motor as physical quantity; that is, the operating amount and the operating direction of the wire.

In the preferred embodiment described above, the example where the shift mechanism 34 has the transmission gear ratio change mechanism 35 is described. However, the shift mechanism 34 may not have the transmission gear ratio change mechanism 35. For example, the shift mechanism 34 may have only the shift position change mechanism 36.

A connection force of a clutch is a value that denotes an engaging state of the clutch. In other words, for example, "the connection force of the transmission gear ratio change hydraulic clutch 53 is 100%" means that the hydraulic piston 53*a* is driven to bring the plate group 53*b* into a completely pressurized contact, and that the transmission gear ratio change hydraulic clutch 53 is completely engaged. On the other hand, for example, "the connection force of the transmission gear ratio change hydraulic clutch 53 is 0%" means that the hydraulic piston 53*a* is not driven to bring the plate group 53*b* into nonpressurized contact with each plate being separated, and that the transmission gear ratio change hydraulic clutch 53 is completely disengaged. Further, for example, "the connection force of the transmission gear ratio change hydraulic clutch 53 is 80%" means that the transmission gear ratio change hydraulic clutch 53 is driven to bring the plate group 53*b* into pressurized contact to establish a so-called half-clutch state in which the drive torque transmitted from the first power transmission shaft 50 as an input shaft to the second power transmission shaft 51 as an output shaft, or the rotational speed of the second power transmission shaft 51, is 80% of the value when the transmission gear change hydraulic clutch 53 is completely engaged.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion system comprising:

a power source arranged to generate a rotational force;

a propulsion unit including a propeller operated by the rotational force of the power source so to generate a propulsive force;

a rotational speed detection section arranged to detect a rotational speed of the propeller;

a shift mechanism disposed between the power source and the propulsion unit and arranged to change between a first shift position, neutral, and a second shift position to transmit the rotational force of the power source to the propulsion unit as a rotational force in a rotational direction opposite to that of the first shift position;

an actuator arranged to drive the shift mechanism;

a control lever to which an accelerator opening and a shift position are input by an operation of an operator;

a shift position detection section arranged to detect the input shift position;

an accelerator opening detection section arranged to detect the input accelerator opening; and a control unit arranged to enable the actuator to select the shift position on the basis of the detected shift position and to control an output of the power source on the basis of the detected accelerator opening; wherein the control unit is arranged to enable the actuator to maintain the first shift position until the rotational speed of the propeller becomes equal to or lower than a predetermined rotational speed and then to change to the second shift position when the control lever is operated such that the shift position detected by the shift position detection section is changed from the first shift position to the second shift position, and such that an absolute value of an accelerator opening varying speed obtained by differentiating the accelerator opening becomes equal to or larger than a predetermined value.

2. The boat propulsion system according to claim 1, wherein the shift mechanism has a transmission gear ratio change mechanism disposed between the power source and the propulsion unit and arranged to change a transmission gear ratio between the power source and the propulsion unit between a low-speed transmission gear ratio and a high-speed transmission gear ratio;

the first shift position includes a first low-speed shift position at which the low-speed transmission gear ratio is selected and a first high-speed shift position at which the high-speed transmission gear ratio is selected; and the control unit is arranged enable the actuator to change the first high-speed shift position to the first low-speed shift position, to maintain the first low-speed shift position until the rotational speed of the propeller becomes equal to or lower than the predetermined rotational speed, and then to change to the second shift position when the control lever is operated such that the shift position detected by the shift position detection section is changed from the first high-speed shift position to the second shift position, and such that the absolute value of the accelerator opening varying speed becomes equal to or larger than the predetermined value.

3. The boat propulsion system according to claim 2, wherein the second shift position includes a second low-speed shift position at which the low-speed transmission gear ratio is selected and a second high-speed shift position at which the high-speed transmission gear ratio is selected; and the control unit is arranged to enable the actuator to change the first high-speed shift position to the first low-speed shift position, to maintain the first low-speed shift position until the rotational speed of the propeller becomes equal to or lower than the predetermined rotational speed, then to change to the second low-speed shift position, and then to change to the second high-speed shift position when the control lever is operated such that the shift position detected by the shift position detection section is changed from the first high-speed shift position to the second high-speed shift position, and such that the absolute value of the accelerator opening varying speed becomes equal to or larger than the predetermined value.

4. The boat propulsion system according to claim 3, wherein the control unit is arranged to enable the actuator to change the first high-speed shift position to the first low-speed shift position, then to maintain the first low-speed shift position until the rotational speed of the propeller becomes equal to or lower than the predetermined rotational speed, then to change to the second low-speed shift position, then to maintain the second low-speed shift position for a predetermined period, and then to change to the second high-speed shift position when the control lever is operated such that the shift position detected by the shift position detection section is changed from the first high-speed shift position to the second high-speed shift position, and such that the absolute value of the accelerator opening varying speed becomes equal to or larger than the predetermined value.

5. The boat propulsion system according to claim 1, wherein, the shift mechanism includes a transmission gear ratio change mechanism disposed between the power source and the propulsion unit and arranged to change a transmission gear ratio between the power source and the propulsion unit between a low-speed transmission gear ratio and a high-speed transmission gear ratio, and a clutch arranged to change an engaging state between the power source and the propulsion unit and is disengaged to set a shift position to neutral, wherein the first shift position includes a first low-speed shift position at which the low-speed transmission gear ratio is selected and a first high-speed shift position at which the high-speed transmission gear ratio is selected, the second shift position includes a second low-speed shift position at which the low-speed transmission gear ratio is selected and a second high-speed shift position at which the high-speed transmission gear ratio is selected, and the control unit is arranged to enable the actuator to select the low-speed transmission gear ratio, then to engage the clutch, and then to select the high-speed transmission gear ratio to select one of the first high-speed shift position and the second high-speed shift position when the control lever is operated such that the shift position detected by the shift position detection section becomes one of the first high-speed shift position and the second high-speed shift position while neutral and the high-speed transmission gear ratio are selected.

6. The boat propulsion system according to claim 1, wherein the shift mechanism has a clutch arranged to change an engaging state between the power source and the propulsion unit and is disengaged to set a shift position to neutral, and the control unit is arranged to gradually increase a connection force of the clutch until the clutch is engaged at the time of changing to the second shift position when the control lever is operated such that the shift position detected by the shift position detection section is changed from the first shift position to the second shift position, and such that the absolute value of the accelerator opening varying speed becomes equal to or larger than the predetermined value.

7. The boat propulsion system according to claim 1, wherein the control unit is arranged to enable the actuator to retain an output of the power source to be constant or to reduce an output from the output at the time when the control lever is operated regardless of the detected accelerator opening during a period when the first shift position is maintained until the rotational speed of the propeller becomes equal to or lower than the predetermined rotational speed when the control lever is operated such that the shift position detected by the shift position detection section is changed from the first shift position to the second shift position, and such that the absolute value of the accelerator opening varying speed obtained by differentiating the accelerator opening becomes equal to or larger than the predetermined value.

8. A control device of a boat propulsion system, the control device comprising:

a power source arranged to generate a rotational force;

a propulsion unit including a propeller operated by the rotational force of the power source so to generate a propulsive force;

a rotational speed detection section arranged to detect a rotational speed of the propeller;

a shift mechanism disposed between the power source and the propulsion unit and arranged to change between a first shift position, neutral, and a second shift position to transmit the rotational force of the power source to the propulsion unit as a rotational force in a rotational direction opposite to that of the first shift position;

an actuator arranged to drive the shift mechanism;

a control lever to which an accelerator opening and a shift position are input by an operation of an operator;

a shift position detection section arranged to detect the input shift position; and an accelerator opening detection section arranged to detect the input accelerator opening; wherein the actuator is arranged to select the shift position on the basis of the detected shift position and to control an output of the power source on the basis of the detected accelerator opening; and the actuator is arranged to maintain the first shift position until the rotational speed of the propeller becomes equal to or lower than a predetermined rotational speed and then to change to the second shift position when the control lever is operated such that the shift position detected by the shift position detection section is changed from the first shift position to the second shift position, and such that an absolute value of an accelerator opening varying speed obtained by differentiating the accelerator opening becomes equal to or larger than a predetermined value.

9. A method of controlling a boat propulsion system, the method comprising the steps of:

generating a rotational force so as to rotate a propeller;

detecting a rotational speed of the propeller;

providing a shift mechanism to shift between a first shift position, neutral, and a second shift position that transmits the rotational force to the propeller as a rotational force in a rotational direction opposite to that of the first shift position;

detecting a shift position of the shift mechanism;

detecting an accelerator opening; and controlling an actuator so as to maintain the first shift position until the rotational speed of the propeller becomes equal to or lower than a predetermined rotational speed and then to change to the second shift position when a control lever is operated such that the detected shift position is changed from the first shift position to the second shift position, and such that an absolute value of an accelerator opening varying speed obtained by differentiating the accelerator opening becomes equal to or larger than a predetermined value.

* * * * *